US007269364B2

(12) United States Patent
Tanaka et al.

(10) Patent No.: US 7,269,364 B2
(45) Date of Patent: Sep. 11, 2007

(54) IMAGE FORMING APPARATUS AND TREATMENT THEREOF

(75) Inventors: Shuji Tanaka, Kanagawa (JP); Takashi Yukutake, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 93 days.

(21) Appl. No.: 11/080,611

(22) Filed: Mar. 16, 2005

(65) Prior Publication Data

US 2006/0029405 A1 Feb. 9, 2006

(30) Foreign Application Priority Data

Aug. 4, 2004 (JP) ..... P2004-228051

(51) Int. Cl.
*G03G 15/08* (2006.01)

(52) U.S. Cl. ..... 399/27; 399/29; 399/257

(58) Field of Classification Search ..... 399/27–30, 399/257

See application file for complete search history.

(56) References Cited

U.S. PATENT DOCUMENTS 7,085,506 B2 * 8/2006 Forbes et al. ..... 399/29

FOREIGN PATENT DOCUMENTS

JP 2000-206744 A 7/2000

* cited by examiner

*Primary Examiner*—Hoang Ngo
(74) *Attorney, Agent, or Firm*—Morgan, Lewis & Bockius LLP

(57) ABSTRACT

An image forming apparatus includes a toner forced discharge treatment for executing a toner discharge mode in which toner inside a developing device is forcedly consumed, and a toner discharge judgment treatment capable of judging necessity of execution of the toner discharge mode based on a decision as to whether or not a toner state inside the developing device is in a state of leading to an image quality defect. Further, the apparatus includes a toner forced supply treatment for executing a toner supply mode in which new toner is supplied from a toner replenishment device to the developing device in addition to execution of the toner discharge mode.

23 Claims, 27 Drawing Sheets

TONER DISCHARGE MODE

TONER SUPPLY MODE

IMAGE FORMING APPARATUS AND TREATMENT THEREOF

BACKGROUND OF THE INVENTION

1. Field of the Invention

The present invention relates to an image forming apparatus such as a copying machine or a printer, and particularly to improvements in an image forming apparatus and treatment useful in a form of outputting an image forming job in which various images are mixed at high speed.

2. Description of the Related Art

In recent years, in an image forming apparatus using an electrophotographic treatment, more speedup of a print output has advanced while image quality is becoming higher. Particularly in an on-demand print system, each component (particularly, a developing device) of the image forming apparatus is forced to be in an image forming state always in order to output an image forming job in which various images such as a full color image or a monochrome image (for example, a monochrome K image: a monochrome black image) are mixed at high speed.

Under such circumstances, when a developing device continues to run successively with respect to an image having a low image density above all, switching of a developing agent (toner) inside the developing device is performed slightly and degradation in the developing agent is advanced and also agglomerated substances of the mutual toner are generated. When the toner agglomerated substances are accumulated inside the developing device and are delivered on an image at the time of outputting a subsequent image of a high image density, there is fear that a region corresponding to the toner agglomerates results in a white spot defect.

Means for solving such trouble includes means described in, for example, JP-A-2000-206744.

The related art described in JP-A-2000-206744 is an art in which when jobs of images with low density continue, an image of a toner discharge patch is formed in an inter-image region and toner inside a developing device is discharged by developing this toner discharge patch by toner and thus an image quality defect such as high background or variations in image density is prevented.

However, this related art treatment is a treatment in which the amount of consumption of toner is accurately detected at a previous stage of development by the developing device and when the amount of consumption of toner is small, the amount of consumption of toner is ensured using the inter-image region, and occurrence of an image quality defect such as high background or variations in image density is merely prevented by performing toner consumption processing integrally with image forming processing.

Therefore, when an image quality defect such as a white spot defect occurs with respect to quality of an image outputted actually, measures of preventing this defect at once cannot be taken and also in the toner consumption treatment using the inter-image region, an image forming area is small originally, so that it is difficult to sufficiently ensure the amount of consumption of toner and a toner agglomerated substance inside a developing agent tends to be discharged insufficiently. Particularly in the case of considering a limit of cleaning by a cleaner, an image density of discharge by the toner discharge patch cannot be increased unnecessarily and it becomes more difficult to ensure the amount of consumption of toner.

SUMMARY OF THE INVENTION

The invention is implemented to solve the technical problems described above, and an object of the invention is to provide an image forming apparatus and treatment in which in a state of leading to an image quality defect such as a white spot defect, the amount of discharge of toner from a developing device is ensured sufficiently and degradation toner or a toner agglomerated substance, etc. can be delivered surely and thus the image quality defect can be solved surely.

According to an aspect of the invention, there is provided an image forming apparatus including: an image carrier which carries an electrostatic latent image; at least one developing device which images the electrostatic latent image formed on the image carrier with use of toner; a toner forced discharge treatment which executes a toner discharge mode in which the toner inside the developing device is forcedly consumed, and a toner discharge judgment treatment capable of judging necessity of execution of the toner discharge mode based on a decision as to whether or not a toner state inside the developing device is in a state of leading to an image quality defect.

According to another aspect of the invention, there is provided an image forming apparatus including: an image carrier which carries an electrostatic latent image; at least one developing device which images the electrostatic latent image formed on the image carrier with use of toner; a toner replenishment device capable of toner replenishment to the developing device; a toner forced discharge treatment which executes a toner discharge mode in which the toner inside the developing device is forcedly consumed; a toner discharge judgment treatment capable of judging necessity of execution of the toner discharge mode based on a decision as to whether or not a toner state inside the developing device is in a state of leading to an image quality defect; and a toner forced supply treatment which executes a toner supply mode in which new toner is supplied from the toner replenishment device to the developing device in addition to execution of the toner discharge mode.

According to still another aspect of the invention, there is provided an image forming treatment used in an image forming apparatus including: an image carrier which carries an electrostatic latent image; at least one developing device which images the electrostatic latent image formed on this image carrier with use of toner; and a toner replenishment device capable of toner replenishment to the developing device, the image forming treatment including: a toner discharge step of executing a toner discharge mode in which the toner inside the developing device is forcedly consumed in a case of deciding that a toner state inside the developing device is in a state of leading to an image quality defect, and a toner supply step of executing a toner supply mode in which new toner is supplied from the toner replenishment device to the developing device in conjunction with execution of the toner discharge mode.

According to an image forming apparatus in accordance with the invention, it is constructed so that in the case of deciding that a toner state inside a developing device is in a state of leading to an image quality defect, a toner discharge mode is executed to forcedly consume toner inside the developing device, so that, for example, even when the developing device is successively operated with respect to an image having a low image density and a toner agglomerated substance or degradation toner which is a factor in the image quality defect inside the developing device is generated, the amount of discharge of toner from the developing device is ensured sufficiently and the degradation toner or the toner agglomerated substance, etc. can be delivered surely and thus the image quality defect can be solved surely.

Further, in the invention, when it is constructed so as to execute a toner supply mode in which new toner is supplied from a toner replenishment device to the developing device in addition to execution of the toner discharge mode, the amount of toner reduction of the toner agglomerated substance or the degradation toner delivered can be supplied and accordingly, the amount of necessary toner inside the developing device can be ensured and a reduction in image quality associated with shortage of toner density can be prevented effectively.

Also, according to an image forming treatment in accordance with the invention, by including a toner discharge step and a toner supply step, the image forming treatment effective in solving an image quality defect surely and preventing a reduction in image quality due to shortage of toner can be provided simply.

BRIEF DESCRIPTION OF THE DRAWING

These and other objects and advantages of this invention will become more fully apparent from the following detailed description taken with the accompanying drawings in which.

DETAILED DESCRIPTION OF THE INVENTION

The invention will be described below in detail based on embodiments shown in the accompanying drawings.

Figure 1A:
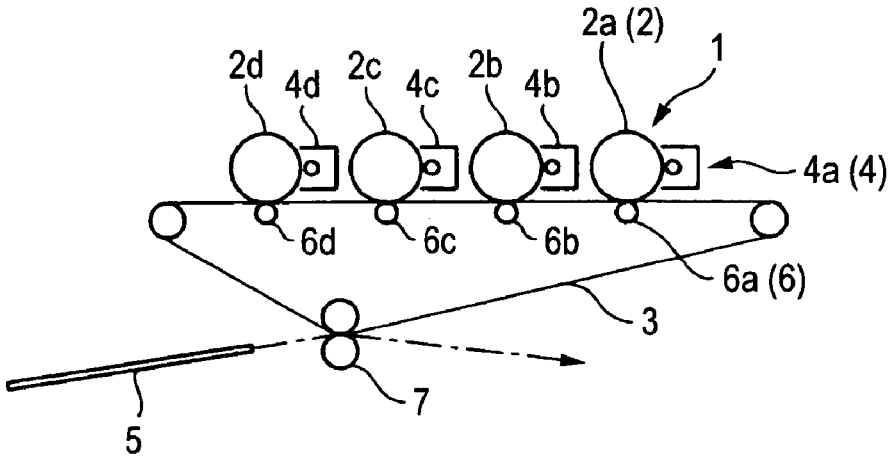
FIG. 1A is an explanatory diagram showing an outline of an image forming apparatus according to the invention and FIG. 1B is an explanatory diagram showing its main part.
Figure 1B:
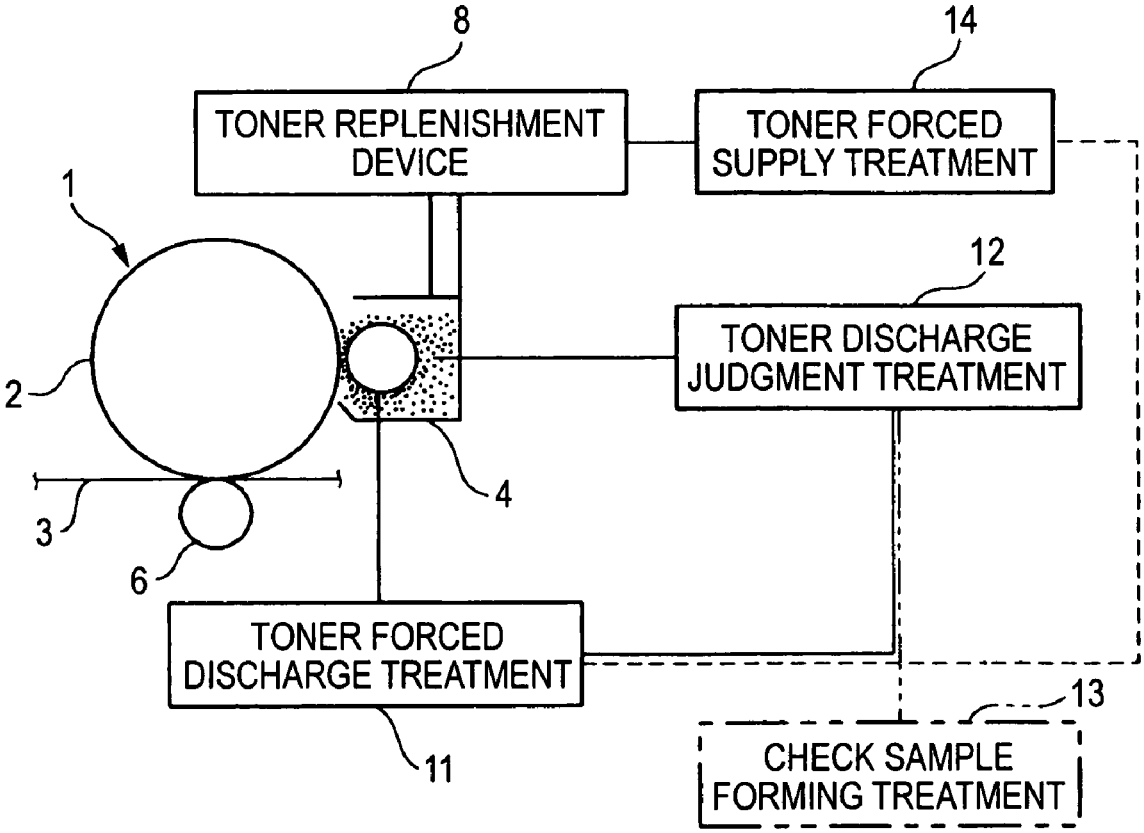

As shown in FIGS. 1A and 1B, in an image forming apparatus including an image carrier 1 for carrying an electrostatic latent image, and one or plural developing devices 4 (for example, 4*a* to 4*d*) for imaging the electrostatic latent image formed on this image carrier 1 by toner, the invention is characterized by including a toner forced discharge treatment 11 for executing a toner discharge mode in which the toner inside the developing device 4 is forcedly consumed, and a toner discharge judgment treatment 12 capable of judging necessity of execution of the toner discharge mode based on a decision as to whether or not a toner state inside the developing device 4 is in a state of leading to an image quality defect.

Incidentally, an image forming apparatus of a tandem type intermediate transfer treatment is illustrated in FIG. 1 and in the present aspect, the image carrier 1 includes plural image forming carriers 2 (for example, 2*a* to 2*d*) for individually forming and carrying each of the color component images, and an intermediate transfer body 3 for primarily transferring each of the color component images formed on each of the image forming carriers 2 through a primary transfer treatment 6 (for example, 6*a* to 6*d*) and then secondarily transferring each of the color component images to a recording material 5 through a secondary transfer treatment 7. However, the image carrier 1 of the invention is not limited to the aspect of FIG. 1 naturally.

In such technical treatments, a target to which the present image forming apparatus is applied is mainly a color image forming apparatus, and also includes a black-and-white image forming type. Also, an image forming treatment of the color image forming apparatus is not limited to the tandem type intermediate transfer treatment shown in FIG. 1 and, for example, a tandem type recording material transport treatment, an aspect of parallel disposing plural developing devices 4 in a four-cycle type or an aspect mounted as a rotary treatment can be applied properly.

Also, as a latent image forming treatment (not shown), for example, an aspect of combining an electrification treatment and an exposure treatment or an aspect of combining an electrification treatment and an ion beam record head may be selected properly as long as an electrostatic latent image is formed on the image carrier 1.

Further, as the developing devices 4, selections may be made properly as long as an electrostatic latent image on the image carrier 1 is imaged by a predetermined color component developing agent and, for example, a developing treatment is not limited to a two-component developing treatment.

Also, the toner forced discharge treatment 11 includes an aspect of disposing a developing agent delivery opening in a portion of a developing agent circulation path and delivering a developing agent through this developing agent delivery opening as well as an aspect of developing toner to the image carrier 1 as long as an aspect capable of forcedly consuming toner.

Also, "whether or not a toner state is in a state of leading to an image quality defect" in the toner discharge judgment treatment 12 refers to a viewpoint as to whether or not to lead to an image quality defect (for example, an image density reduces or a white spot defect occurs) resulting from toner degradation or a toner agglomerated substance, and it may be constructed so as to directly decide a toner state or indirectly decide a toner state by an image using toner.

Further, treatment "capable of judging necessity of execution of the toner discharge mode" may be a judgment treatment capable of manual operation by observing a decision result or may be automatic judgment based on a decision result as long as treatment capable of making judgment based on a toner state.

Particularly, when an image using toner is a target of decision, as shown in FIG. 1B, it preferably includes a check sample forming treatment 13 for forming and outputting a check sample for toner state decision inside the developing device 4 to a recording material 5 and in the present aspect, the toner discharge judgment treatment 12 could be treatment capable of judging necessity of execution of the toner discharge mode based on the check sample for toner state decision.

Also, the toner discharge judgment treatment 12 is not limited to the aspect using the check sample, and may be an aspect using information about the past image output.

In this case, the toner discharge judgment treatment 12 could be treatment capable of recognizing information about the past image output for toner state decision and judging necessity of execution of the toner discharge mode based on this recognition result. Here, the information about the past image output includes an image density, a toner density, a recording material size, recording material basis weight, the degree of white spot trouble of the immediately previous image sample, etc.

Further, in an aspect of using, for example, a judgment treatment capable of manual operation of the toner discharge judgment treatment 12, it could be treatment capable of judging necessity of execution of the toner discharge mode based on an instruction operation by an instruction device. Here, the instruction device may be selected properly, for example, button type device.

Furthermore, the toner discharge judgment treatment 12 may be constructed so as to be able to judge necessity of execution of the toner discharge mode in consideration of an environmental condition. In this case, by considering the environmental condition, timing of execution of the toner discharge mode can be selected according to environment.

Also, the invention can broadly be applied to an image forming apparatus and, for example, can also be applied to a remote type image forming apparatus (an image forming apparatus of an aspect of making network connection to a central control device).

In this case, the toner discharge judgment treatment 12 could be treatment capable of judging necessity of execution of the toner discharge mode by remote operation from the central control device.

Further, the toner discharge judgment treatment 12 includes an aspect using an image reading part such as a scanner. This toner discharge judgment treatment 12 includes a treatment capable of reading the immediately previous image sample by the image reading part and judging necessity of execution of the toner discharge mode based on this read information. In this case, for example, it could be constructed so as to make an automatic determination by comparing an image sample with image information stored previously, or could be constructed so as to use a technique for counting the number of white spots in an image sample.

Furthermore, of the image forming apparatus, in an aspect including a developing device 4 (for example, 4*a*) in which yellow component toner is received, the toner discharge judgment treatment 12 for the yellow developing device 4 (4*a*) could be constructed so as to use a sample image including a yellow secondary color as an image for toner state decision. According to the present aspect, in the case of discriminating an image by the yellow toner, discrimination in single color of yellow is difficult but for the yellow secondary color, discrimination is easy, so that a state of the yellow toner can be decided accurately.

Also, a typical aspect of the toner forced discharge treatment 11 includes a treatment for developing toner discharged from the developing device 4 in the image carrier 1. A toner discharge treatment can be selected properly and from the viewpoint of simplification of a configuration, a treatment for developing the discharged toner in the image carrier 1 by the discharged toner using a development action is preferable.

In the present aspect, a treatment for developing toner discharged from the developing device 4 in at least an image forming region of the image carrier 1 is preferable, and a larger amount of discharge of toner can be ensured as compared with an aspect of discharging toner in an inter-image region.

Here, "at least an image forming region of the image carrier 1" treatment that an aspect of developing the discharged toner across the image forming region and the inter-image region is also included, and in this case, a larger amount of discharge of toner can be ensured.

Also, a discharge destination of the final toner of the toner forced discharge treatment 11 may be selected properly, and the typical aspect includes a treatment for developing toner discharged from the developing device 4 in an image forming region of the image carrier 1 and extracting a developed image by the discharged toner to a recording material 5. In this case, the developed image by the discharged toner can be selected properly, for example, a solid image (solid image) is formed, or images of plural colors are formed to the same recording material 5, or a patch is formed.

Further, another aspect of the toner forced discharge treatment 11 includes a treatment for developing toner discharged from the developing device 4 on the image carrier 1 and removing the discharged toner by a cleaner (not shown).

Furthermore, for example, in the aspect of developing the discharged toner across the image forming region and the inter-image region, it may be constructed so that a developed image by the discharged toner of the image forming region is extracted to a recording material 5 while a developed image by the discharged toner of the inter-image region is removed by a cleaner.

Also, with respect to the amount of discharge of toner by the toner forced discharge treatment 11, a treatment for estimating the number of generations of a toner agglomerated substance and the degree of degradation in toner according to the degree of a toner state decided at the time of judgment by the toner discharge judgment treatment 12 and determining the amount of discharge of toner in the range capable of delivering the degradation toner and the toner agglomerated substance at once is preferable. According to the present aspect, the degradation toner and the toner agglomerated substance can be discharged efficiently by determining the amount of discharge of toner according to a toner state inside the developing device 4.

Further, from the viewpoint of efficiently delivering the toner agglomerated substance, a treatment for discharging toner in order to develop a solid image (solid image) over at least almost all of the image forming region of the image carrier 1 is preferable. Thus, in the case of developing all the solid image with a large development electric field, the toner agglomerated substance can be delivered to the outside of the developing device 4 more efficiently.

Furthermore, from the viewpoint of ensuring a large amount of discharge of toner by the toner forced discharge treatment 11, a treatment for increasing the amount of development of toner at the time of executing the toner discharge mode than the time of a normal mode is preferable. Thus, a speedup in a discharge action of toner can be achieved by increasing the amount of discharge of toner.

Moreover, in an aspect of using a recording material 5 at the time of the toner discharge mode, the used recording material 5 may be selected arbitrarily by the toner forced discharge treatment 11, and a preferable judgment treatment of the used recording material 5 includes a treatment for selecting a recording material 5 with the maximum use size at the time of executing the toner discharge mode and extracting a developed image by the discharged toner to the recording material 5. According to the present aspect, a discharge action of toner can be performed efficiently in an acceleration manner.

Also, in an aspect in which the toner forced discharge treatment 11 extracts an image by the discharged toner to the recording material 5, the recording material 5 is used for the toner discharge mode, so that it is preferable to distinguish the number of normal recording materials from the number of recording materials at the time of the toner discharge mode.

Under such a request, the toner forced discharge treatment 11 could be constructed so as to exclude the number of recording materials used at the time of the toner discharge mode from the number of normal recording materials and, for example, in the case of a use contract according to the number of recording materials, a user burden of toner consumption by the toner discharge mode can be avoided.

Further, another aspect of the toner forced discharge treatment 11 includes a treatment for holding data of the number of recording materials used at the time of the toner discharge mode in a record medium capable of updating. According to the present aspect, for example, even in the case of a use contract according to the number of recording materials, toner consumption by the toner discharge mode can be grasped and by excluding this toner consumption from the number of recording materials used, a user burden can be avoided.

Also, as described above, the invention could include at least the toner forced discharge treatment 11 and the toner discharge judgment treatment 12, but the following aspect can be given more preferably.

That is, as shown in FIGS. 1A and 1B, in an image forming apparatus including an image carrier 1 for carrying an electrostatic latent image, and one or plural developing devices 4 (4*a* to 4*d*) for imaging the electrostatic latent image formed on this image carrier 1 by toner, the image forming apparatus having an aspect of annexing a toner replenishment device 8 capable of toner replenishment to the developing device 4, the invention is characterized by including a toner forced discharge treatment 11 for executing a toner discharge mode in which the toner inside the developing device 4 is forcedly consumed, a toner discharge judgment treatment 12 capable of judging necessity of execution of the toner discharge mode based on a decision as to whether or not a toner state inside the developing device 4 is in a state of leading to an image quality defect, and a toner forced supply treatment 14 for executing a toner supply mode in which new toner is supplied from the toner replenishment device 8 to the developing device 4 in addition to execution of the toner discharge mode.

In the present aspect, the toner replenishment device 8 broadly includes a treatment for replenishment of toner, and an aspect of replenishment of only toner, an aspect of simultaneous replenishment of toner and a carrier or an aspect of individual replenishment of toner and a carrier, etc. are given.

Also, by executing the toner supply mode by the toner forced supply treatment 14, the amount of toner reduction of a toner agglomerated substance or degradation toner delivered can be supplied and the amount of necessary toner inside the developing device 4 can be ensured.

Further, an execution start of the toner supply mode by the toner forced supply treatment 14 may be constructed so as to be made independently of the toner discharge mode, but is preferably constructed so as to be made in association with the toner discharge mode of the toner forced discharge treatment 11 and, for example, it could be constructed so as to execute the toner supply mode in conjunction with execution of the toner discharge mode.

Here, a treatment "in conjunction with execution of the toner discharge mode" may be selected properly, for example, execution of the toner supply mode is started in synchronization with predetermined timing during execution of the toner discharge mode, or execution of the toner supply mode is started in synchronization with predetermined timing after the completion of execution of the toner discharge mode.

Also, preferable aspects of the toner forced supply treatment 14 include aspects of controlling the toner supply mode according to a toner density inside the developing device 4 or controlling the toner supply mode according to a toner image density during execution of the toner supply mode or controlling the toner supply mode in order to reach a predetermined target toner density. According to these aspects, toner supply and toner density control or a setup can go hand in hand.

Further, in an aspect of adding the toner forced supply treatment 14, an aspect easy to check an execution result of the toner supply mode is preferable.

This kind of aspect could be constructed so that check sample forming treatment 13 for forming and outputting a check sample for toner state decision inside the developing device 4 to a recording material 5 is had and the toner forced supply treatment 14 forms and outputs the check sample by the check sample forming treatment 13 after executing the toner supply mode.

Also, in an aspect having a check sample forming treatment 13 for forming and outputting a check sample for toner state decision inside the developing device 4 to a recording material 5, an aspect in which the toner discharge judgment treatment 12 can judge necessity of execution of the toner discharge mode based on the check sample for toner state decision and the toner forced supply treatment 14 forms and outputs the check sample by the check sample forming treatment 13 after executing the toner supply mode is preferable.

According to the present aspect, it is preferable in the point that automation of toner discharge and supply processing is achieved by a series of processing actions of "check sample→toner discharge mode→toner supply mode→check sample".

Also, in an aspect including a toner replenishment device 8, the toner forced discharge treatment 11 is preferably treatment for deciding necessity of execution of the toner discharge mode according to the residual amount of toner of the toner replenishment device 8. According to the present aspect, when the residual amount of toner of the toner replenishment device 8 is in a shortage state, a toner replenishment action by a toner replenishment mode after the toner discharge mode cannot be performed surely, so that it can be constructed so as not to execute the toner discharge mode previously.

Then, the toner forced discharge treatment 11 preferably performs processing of stopping the apparatus itself in the case of deciding that it is impossible to execute the toner discharge mode. Thus, there is no fear that image forming processing by the image forming apparatus is performed by mistake.

Also, the invention is not limited to the image forming apparatus described above, and can also target an image forming treatment when components of the image forming apparatus are grasped in a time series manner.

Figure 2:
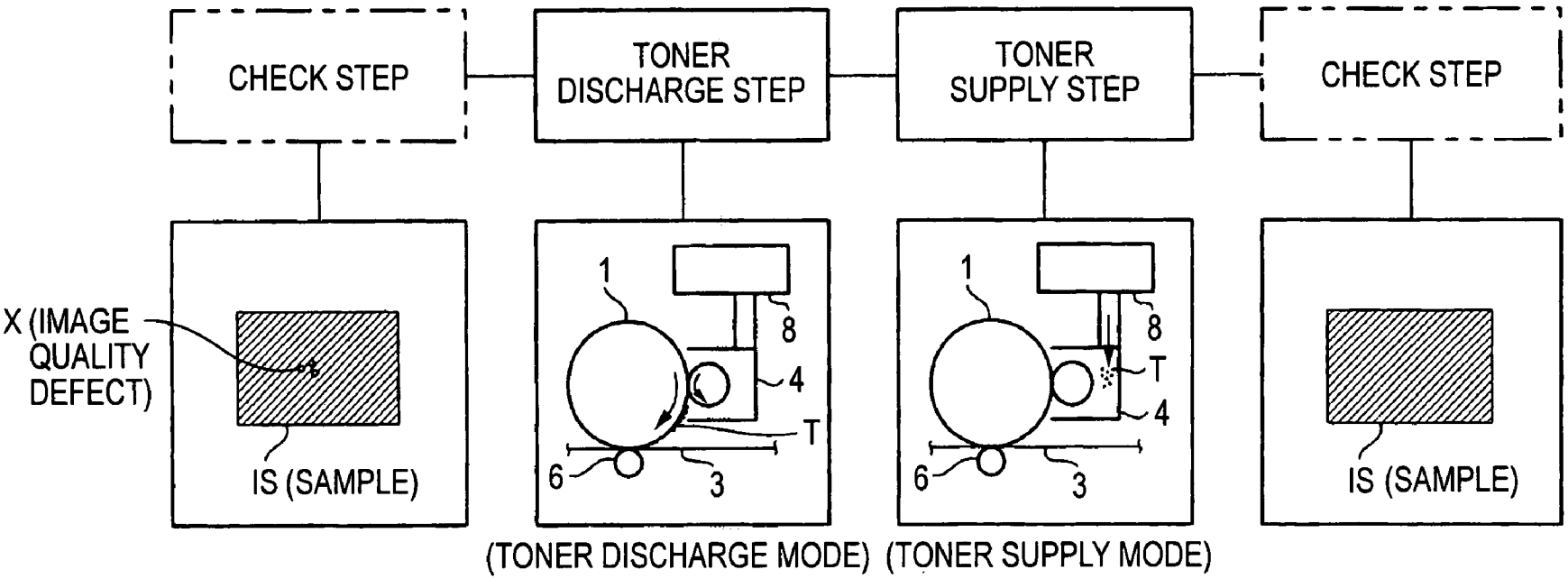
FIG. 2 is an explanatory diagram showing action of the image forming apparatus according to the invention.

In this case, as shown in FIGS. 1A, 1B and 2, in an image forming treatment used in an image forming apparatus including an image carrier 1 for carrying an electrostatic latent image, and one or plural developing devices 4 (for example, 4*a* to 4*d*) for imaging the electrostatic latent image formed on this image carrier 1 by toner, the image forming apparatus having an aspect of annexing a toner replenishment device 8 capable of toner replenishment to the developing device 4, the invention could include a toner discharge step of executing a toner discharge mode in which the toner inside the developing device is forcedly consumed in the case of deciding that a toner state inside the developing device 4 is in a state of leading to an image quality defect, and a toner supply step of executing a toner supply mode in which new toner is supplied from the toner replenishment device to the developing device in conjunction with execution of this toner discharge mode.

By including the toner discharge step and the toner supply step thus, shortage toner can be supplied while delivering degradation toner and a toner agglomerated substance.

Particularly, in such image forming steps, as shown in FIG. 2, it is preferable to include a check step of forming and outputting a check sample for toner state decision inside the developing device 4 before the toner discharge step and after the toner supply step, and it is easy to grasp a toner state inside the developing device 4.

First Embodiment

Figure 3:
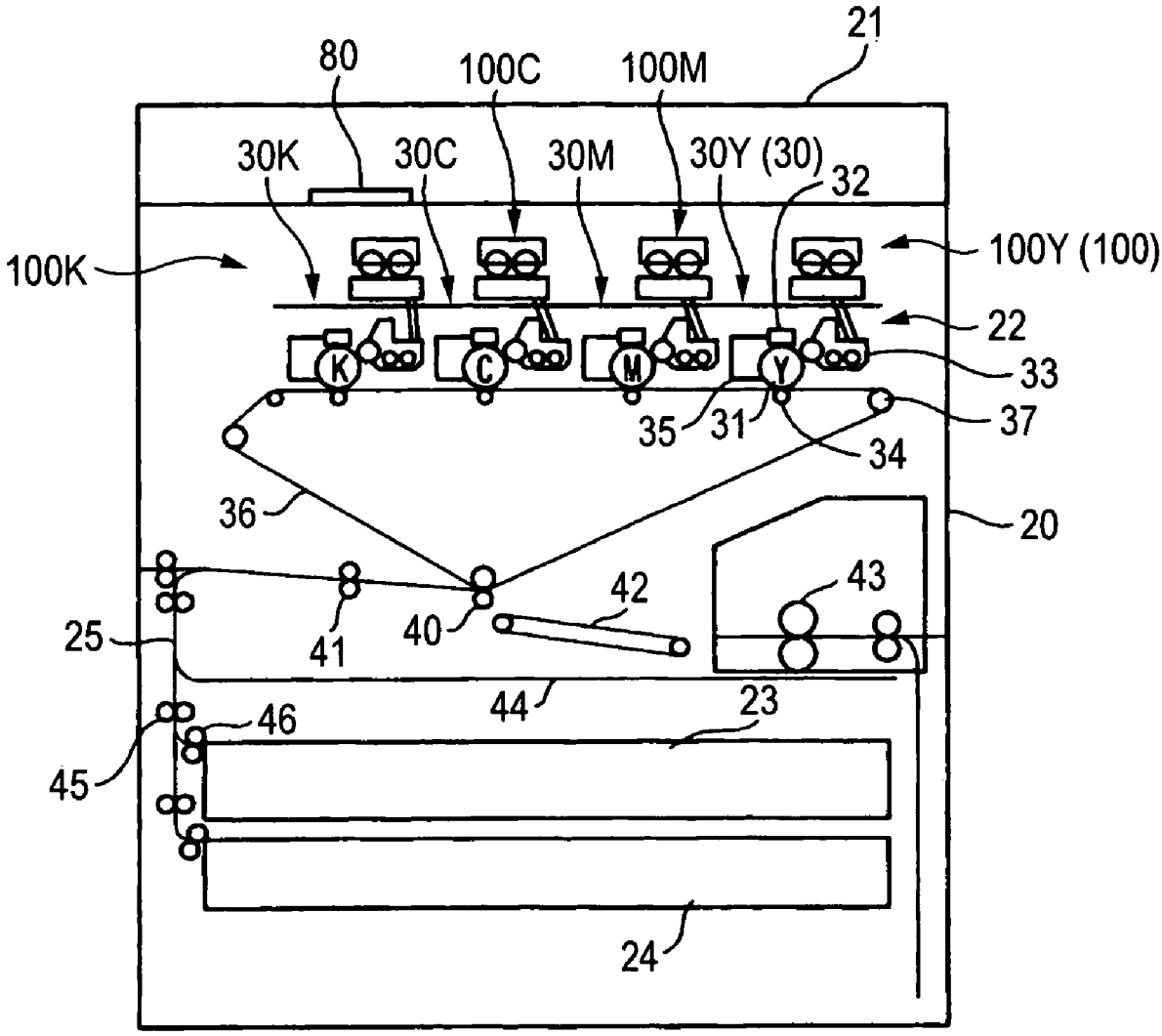
FIG. 3 is an explanatory diagram showing the whole configuration of a first embodiment of an image forming apparatus to which the invention is applied.

FIG. 3 is an explanatory diagram showing the whole configuration of a first embodiment of an image forming apparatus to which the invention is applied.

In FIG. 3, a basic configuration of the image forming apparatus is a configuration constructed so that an image reading unit 21 is disposed in an upper portion of an apparatus body 20 and also an image forming engine 22 equipped with, for example, tandem type image forming units 30 is disposed inside the apparatus body 20 and also sheet supply trays 23, 24 are disposed in a lower portion of this image forming engine 22 and a sheet (paper) supplied from the sheet supply trays 23, 24 is fed to the image forming engine 22 through a sheet transport path 25 and an image is formed on the sheet by this image forming engine 22 and thereafter the sheet on which the image is formed is delivered to the outside of the apparatus body 20 through the sheet transport path 25.

In the present embodiment, the image forming engine 22 has the image forming units 30 (30Y to 30K) for forming images of each of the colors such as yellow (Y), magenta (M), cyan (C) and black (K), and an intermediate transfer belt 36 is disposed in a lower portion of each of the image forming units 30 and also the images transferred on this intermediate transfer belt 36 are collectively transferred to a sheet by a collective transfer device 40.

Here, the image forming units 30 are constructed by, for example, a treatment adopting an electrophotographic treatment, and an electrification device 32 for electrifying a photoconductor drum 31, an exposure device (not shown) for writing an electrostatic latent image on the photoconductor drum 31 electrified, a developing device 33 for imaging the electrostatic latent image written on the photoconductor drum 31 by predetermined color toner, a primary transfer device 34 for primarily transferring a toner image on the photoconductor drum 31 onto the intermediate transfer belt 36 and a cleaning device (drum cleaner) 35 for cleaning the residual toner on the photoconductor drum 31 are sequentially disposed in the periphery of the photoconductor drum 31.

Also, the intermediate transfer belt 36 is looped over plural loop rolls 37, and the collective transfer device 40 is made of, for example, a bias roll for applying a transfer bias, and one of the loop rolls 37 is arranged oppositely as a backup roll. Incidentally, a belt cleaner (not shown) is disposed in the downstream side of a secondary transfer portion of the intermediate transfer belt 36, and the residual toner on the intermediate transfer belt 36 is recovered or electrified in opposite polarity and is moved from a primary transfer portion to the side of the photoconductor drum 31 and can be recovered by the drum cleaner 35.

Further, a registration roll (registration roll) 41 for sheet registration is disposed in the front of a collective transfer portion of the sheet transport path 25 and after passing through the collective transfer portion, for example, a transport belt 42 is disposed and a fixing device 43 for fixing an unfixed image on a sheet is disposed in the downstream side of the transport belt 42. Incidentally, numeral 44 is a sheet return transport path which is one element of the sheet transport path 25 and returns a one-sided recorded sheet to the collective transfer portion of the image forming engine 22 in order to enable two-sided recording of a sheet, and numeral 45 is a proper number of transport rolls disposed in the sheet transport path 25, and numeral 46 is a feeder for feeding out a sheet of each of the sheet supply trays 23, 24.

Particularly, in the embodiment, toner replenishment devices 100 (100Y to 100K) are respectively annexed to the developing devices 33 of each of the image forming units 30 (30Y to 30K).

Figure 4:
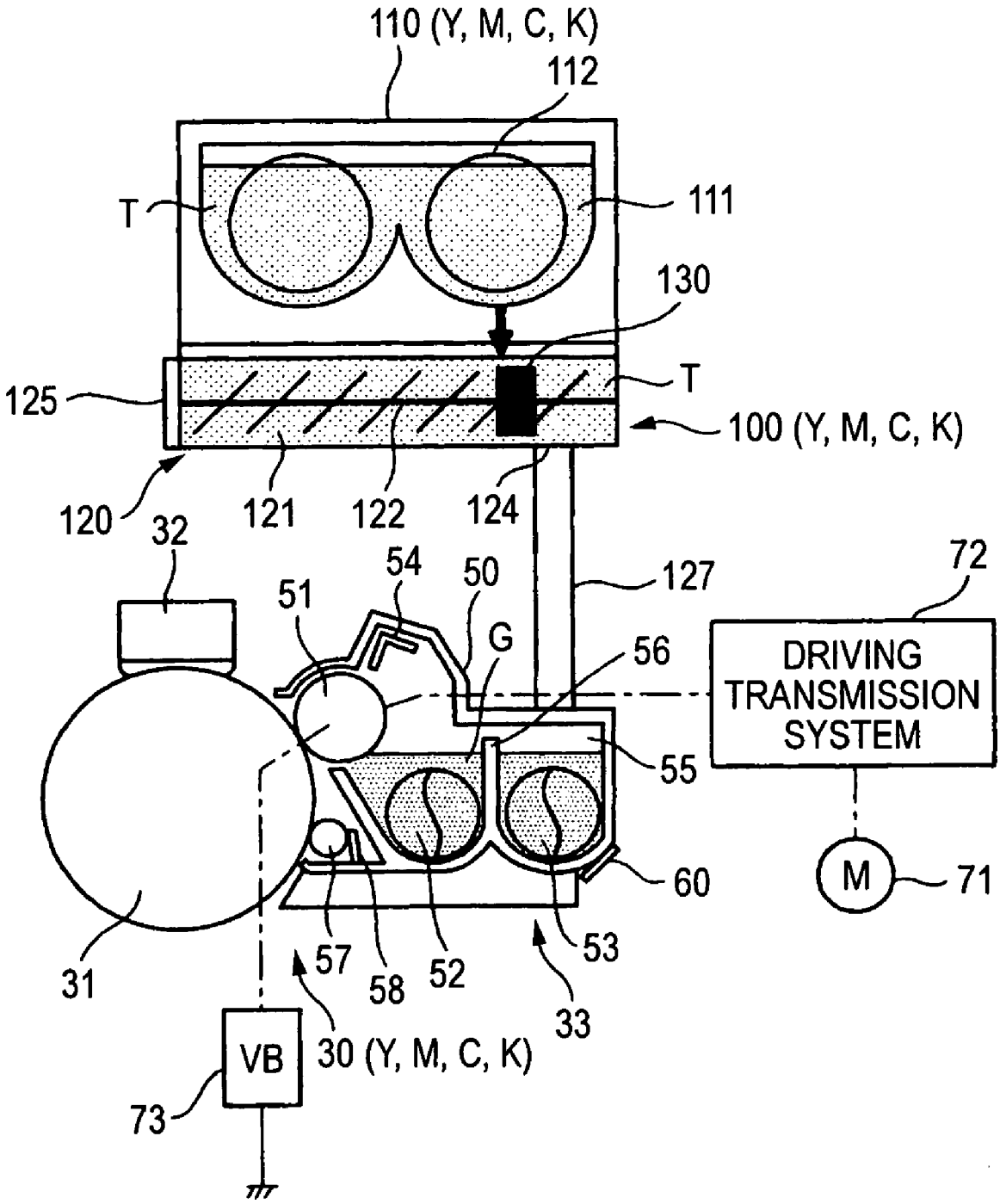
FIG. 4 is an explanatory diagram showing a configuration of a developing device and the periphery used in the first embodiment.

Here, in the embodiment, as shown in FIGS. 3 and 4, the developing device 33 has a developing housing 50 opened to the side of the photoconductor drum 31 and a developing agent G including toner and a carrier is received inside this developing housing 50 and also a developing roll 51 is disposed in a place facing an opening of the developing housing 50 and also agitation transport augers 52, 53 are disposed in the rear side of this developing housing 50 and further a trimming member 54 of layer thickness regulation of the developing agent is disposed in the periphery of the developing roll 51 and after the developing agent agitated and transported by the agitation transport augers 52, 53 is carried to the developing roll 51, the layer thickness is regulated by the trimming member 54 and the developing agent is supplied to a development portion between the developing roll 51 and the photoconductor drum 31.

Also, in the embodiment, the developing roll 51 has a fixed magnet roll in which plural magnetic poles are arranged in the inside, and a non-magnetic developing sleeve is rotatably disposed in the periphery of this magnet roll. Then, it is constructed so that driving force from a driving motor 71 is transmitted to the developing sleeve of the developing roll 51 through a driving transmission system 72 and is also constructed so that a development bias VB is applied from a bias power source 73. Here, as the development bias VB, a bias of only a DC component may be used or a bias in which an AC component is superimposed on a DC component may be used.

Further, in the embodiment, a toner density sensor 60 for toner density detection inside the developing housing 50 is disposed, but it is not limited to this and, for example, a treatment in which a patch for density detection is made on the photoconductor drum 31 and this patch for density detection is detected by a density sensor such as an optical sensor may be disposed.

Incidentally, in FIG. 4, numeral 57 is a carrier recovery roll for recovering a carrier moved to the side of the photoconductor drum 31, and numeral 58 is a scraper annexed to the carrier recovery roll 57.

Also, as shown in FIGS. 3 and 4, the toner replenishment devices 100 (100Y to 100K) includes cartridges 110 (110Y to 110K) in which each color toner T is received, and reserve tanks 120 for temporarily reserving the toner T inside the cartridges 110.

Here, with respect to the number of cartridges 110, the cartridges 110 may be disposed one by one on each color toner and, for example, two cartridges may be used for black toner according to use frequency, and the number may be selected properly and in the embodiment, the aspect using the cartridges one by one is shown.

In the embodiment, the cartridge 110 has a receiving transport path 111 in which the toner T is received, and a proper number (for example, two) of transport members 112 are disposed in this receiving transport path 111 and also the transport members 112 can be driven by a cartridge motor (not shown) and further a communication opening (not shown) is opened in a lower portion of one end of the receiving transport path 111. As the transport members 112 described herein, for example, a coil-shaped agitator and a crank-shaped paddle are used, but it is not limited to this and judgment may be made properly. Incidentally, the apparatus body 20 is provided with an openable cover (dispensing door) (not shown) which is opened in the case of attaching the cartridge 110 and also, a cartridge receiving part (not shown) in which the cartridge 110 can be fitted is formed.

Also, the reserve tank 120 is formed in a container shape opened upward and extending in a direction perpendicular to the cartridge 110, and a movement transport path 121 which communicates with a communication opening (not shown) of the cartridge 110 and in which toner can move is disposed inside this reserve tank 120. Then, a proper number of transport members 122 are disposed inside this movement transport path 121 and as the transport members 122, for example, a transport auger rotating in a predetermined direction at the center of the movement transport path 121 and coil-shaped agitators disposed in both ends of this transport auger are used and these transport members 122 can be driven by driving force from a reserve tank motor (corresponding to a dispensing motor) 125 through a driving transmission gear train (not shown). Also, a replenishment opening 124 capable of being opened and closed by, for example, a shutter is disposed in the downstream side of a movement transport direction of the movement transport path 121 and this replenishment opening 124 is communicated and connected to the developing housing 50 through a communication pipe 127.

Furthermore, a toner presence and absence sensor (Low Toner Sensor) 130 is disposed in the vicinity of the replenishment opening 124 of the reserve tank 120.

This toner presence and absence sensor 130 is a sensor for detecting that the cartridge 110 is in an empty state with toner reserved inside the reserve tank 120, and in the present example, it is disposed so as to detect the absence of toner in a state in which the amount of toner filling inside the reserve tank 120 is at an about full level.

As this toner presence and absence sensor 130, for example, a sensor is constructed of a piezoelectric such as a piezo element and the sensor in which while vibration of a vibrator is suppressed by the press force on condition that the periphery is filled with toner, the vibration of the vibrator becomes manifest and is taken out as an electrical signal since the press force by the toner does not act on condition that the toner is absent in the periphery is used.

Figure 5:
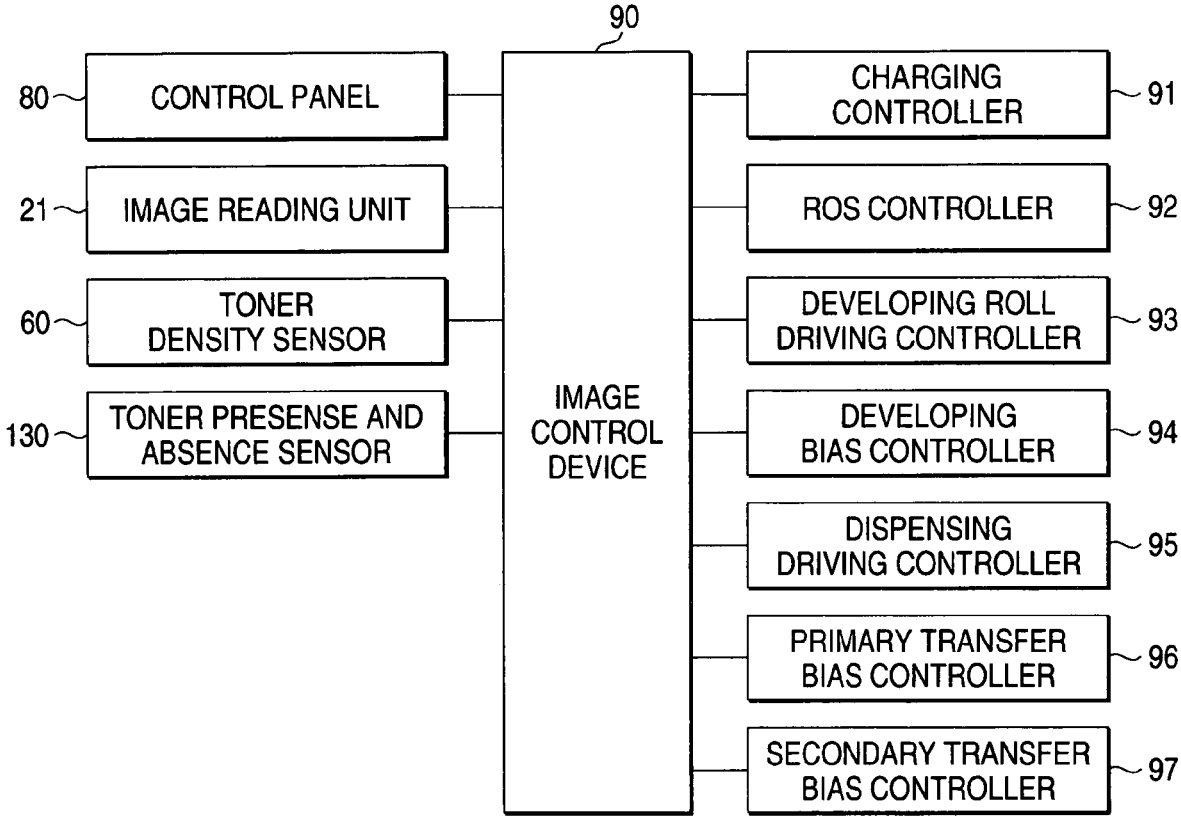
FIG. 5 is an explanatory diagram showing an image forming control system of the image forming apparatus used in the first embodiment.

In the embodiment, the image forming apparatus is provided with an image forming control device 90 for controlling each of the image forming units 30, the intermediate transfer belt 36 and a paper transport system, etc. as shown in FIG. 5. This image forming control device 90 is constructed of a microcomputer system including, for example, a CPU, ROM, RAM and an I/O port, and is configured so that image forming processing programs (for example, including a refresh mode image forming processing program shown in FIG. 7) necessary to implement a series of image forming processing are preinstalled into the ROM and input signals etc. from a control panel 80 which is a user interface, the image reading unit 21, the toner density sensor 60, the toner presence and absence sensor 130 are captured in the CPU and predetermined control signals are generated by executing the image forming processing program by the CPU and each of the control signals is sent to an charging controller 91 for control of the electrification device 32, a ROS controller 92 for control of the exposure device (not shown), a developing roll driving controller 93, a development bias controller 94, a dispensing driving controller 95 for control of the toner replenishment devices 100, a primary transfer bias controller 96 and a secondary transfer bias controller 97, etc.

Figure 6:
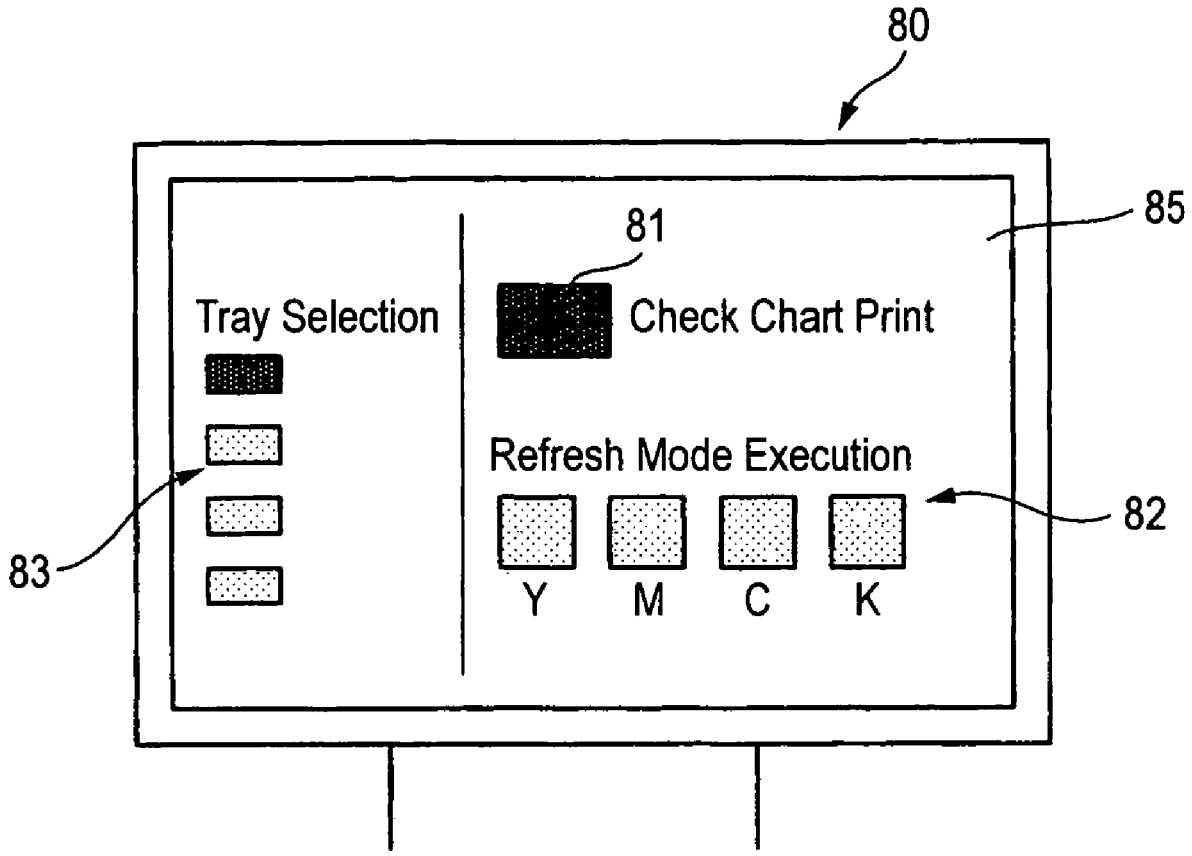
FIG. 6 is an explanatory diagram showing one example of a control panel used in the first embodiment.

Also, in the embodiment, as shown in FIG. 3, the control panel 80 is disposed in a portion of the apparatus body 20 and includes, for example, various switches 81 to 83 capable of being pressed and selected on a touch panel 85 as shown in FIG. 6.

In FIG. 6, numeral 81 is a check chart print switch for printing a check chart for checking an image quality defect, and numeral 82 is refresh mode execution switches capable of selecting execution of refresh modes for each color component (Y, M, C, K), and numeral 83 is tray selection switches for selecting the sheet supply trays 23, 24.

Next, an operation of the image forming apparatus according to the embodiment will be described.

In the embodiment, it is assumed that image forming mode selection switches (not shown) for selecting various image forming modes (a full color mode, a monochrome mode, a two color mode, etc.) are disposed on the control panel 80.

When, for example, a full color mode is selected now, the image forming control device 90 executes a normal image forming processing program and toner images for each component are formed by each of the image forming units 30 (30Y to 30K) and each of the color component toner images is primarily transferred to the intermediate transfer belt 36 and then is secondarily transferred to a sheet by the collective transfer device 40 and the toner images on the sheet are fixed through the fixing device 43 and then the sheet is delivered to a sheet delivery tray (not shown).

When the developing device 33 continues to run successively with respect to, for example, an image having low image density in such image forming processing, there are fears that switching of the toner is slightly performed inside the developing device 33 and degradation in the developing agent is advanced and also agglomerated substances of the mutual toner are generated.

In this case, the toner agglomerated substances are accumulated inside the developing device 33, so that at the time of outputting a subsequent image of high image density, the toner agglomerated substances tend to be delivered and accordingly, an image quality defect such as a white spot defect tends to occur.

Figure 7:
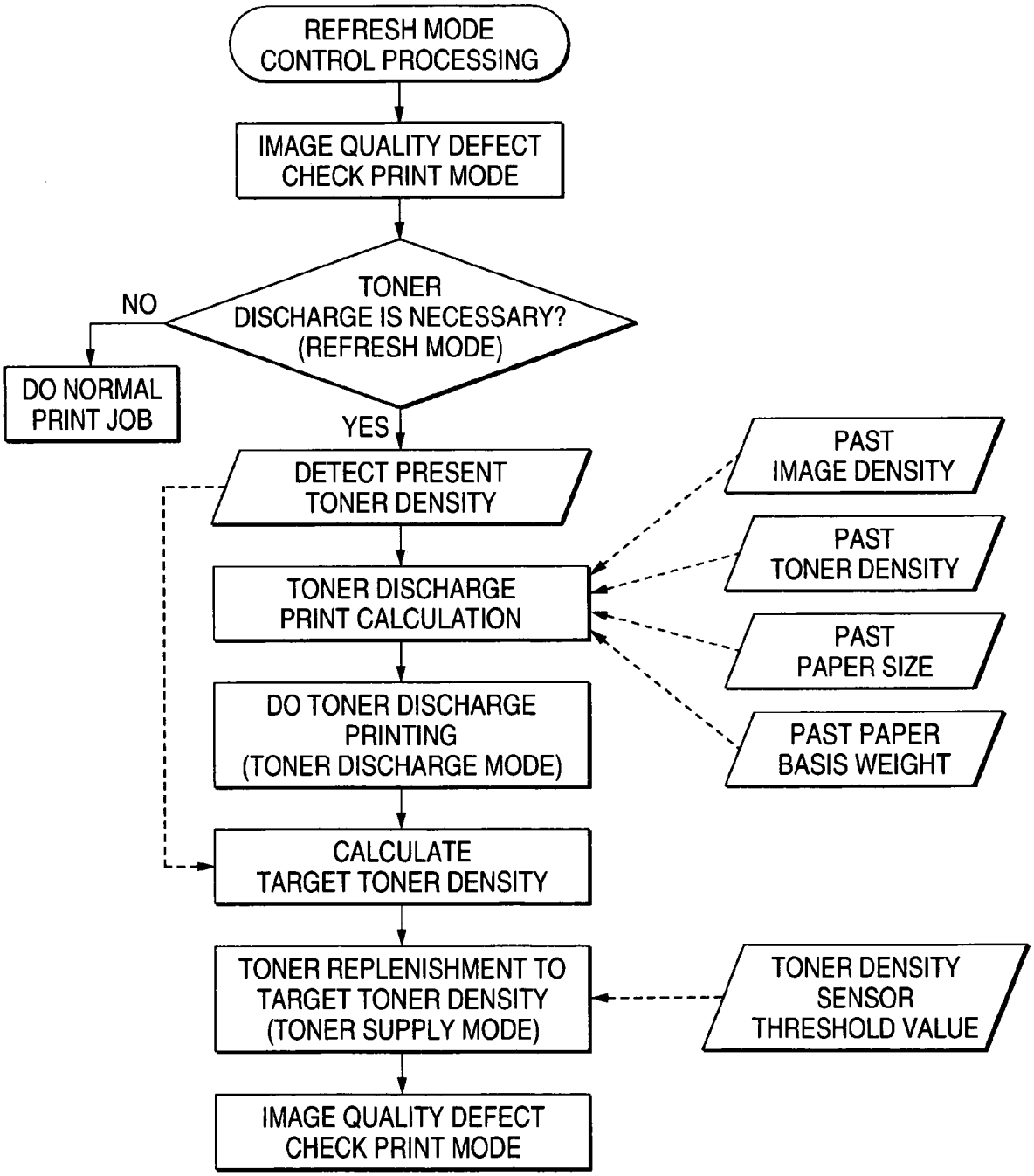
FIG. 7 is a flowchart showing the contents of control processing of a refresh mode used in the first embodiment.

Under such circumstances, it could be constructed so as to perform refresh mode control processing by the image forming control device 90 as shown in FIG. 7.

Figure 8:
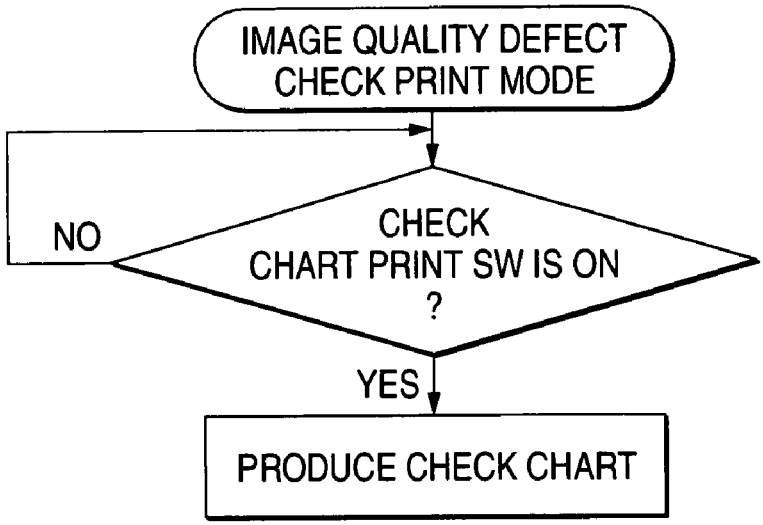
FIG. 8 is a flowchart showing the contents of processing of an image quality defect check print mode of FIG. 7.

In the embodiment, image forming control processing executes an image quality defect check print mode. As shown in FIG. 8, this image quality defect check print mode checks whether or not the check chart print switch 81 (see FIG. 6) on the control panel 80 is pressed and operated (on) and when the switch is turned on, a predetermined check chart (check sample) is produced.

In the embodiment, as the check chart, selection may be made properly as long as the check chart has each of the color component toner images and is an image pattern (for example, a halftone solid image) capable of grasping whether or not a white spot defect is present in each of the color component toner images. In this case, discrimination in single color of yellow is difficult in a yellow component toner image, so that it is desirable to produce the check chart using yellow secondary color (for example, yellow plus magenta, or yellow plus cyan) in consideration of the discrimination.

Next, the image forming control device 90 performs necessity determination processing of toner discharge (refresh mode).

In the embodiment, a user checks whether or not a white spot defect can be checked visually in the check chart produced, and when the white spot defect can be checked visually, the refresh mode execution switch 82 is pressed and operated with respect to the corresponding color.

Figure 9:
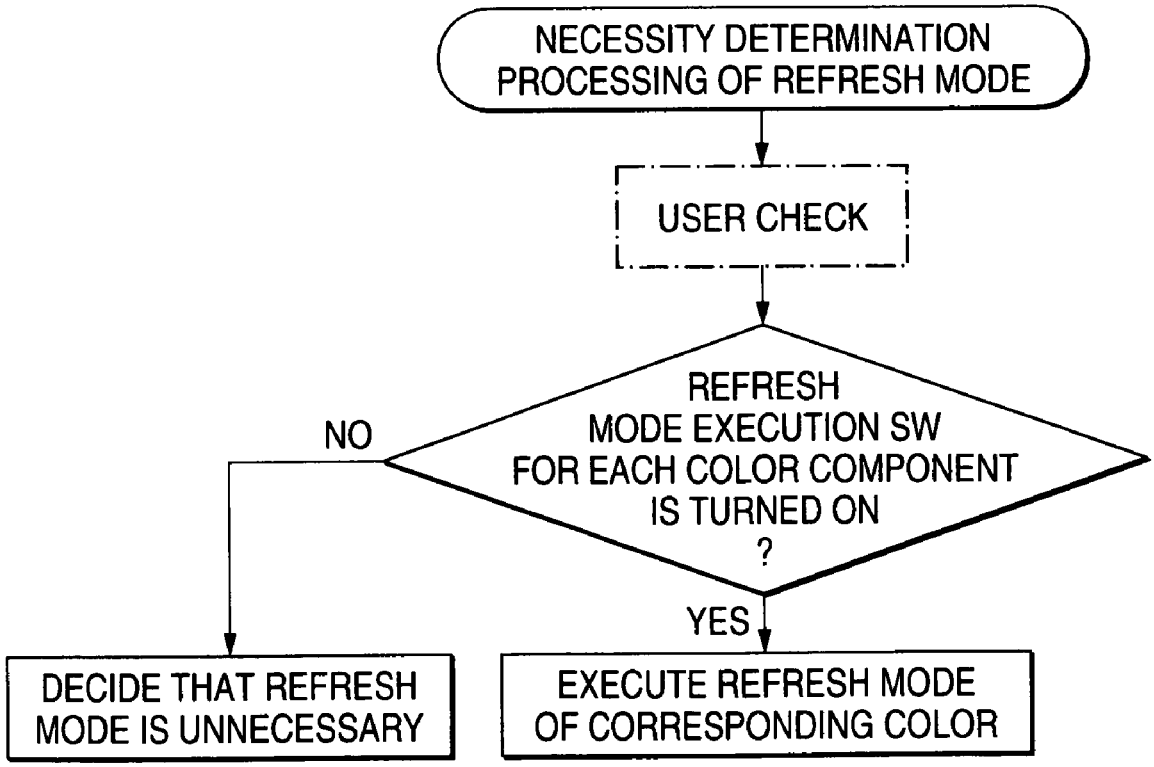
FIG. 9 is a flowchart showing refresh mode necessity determination processing of FIG. 7.

In this case, as shown in FIGS. 7 and 9, the image forming control device 90 checks whether or not the refresh mode execution switches 82 for each color component are turned on, and when any of the switches are turned on, a refresh mode of the corresponding color is executed and on the other hand, when any of the switches are not turned on, it is decided that a refresh mode is unnecessary and a normal print job can be done.

In the embodiment, as the contents of execution processing of a refresh mode, the present toner density is first detected by the toner density sensor 60 and based on this toner density, a target toner density is calculated as shown in FIG. 7. Specifically, it could be constructed so that when the present toner density is higher than or equal to a predetermined threshold value, the present toner density is set to the target toner density and on the other hand, when the present toner density is lower than the predetermined threshold value, the predetermined threshold value is set to the target toner density. Incidentally, treatments for calculating the target toner density may be selected properly, for example, setting of exceeding the present toner density is made.

Figure 10:
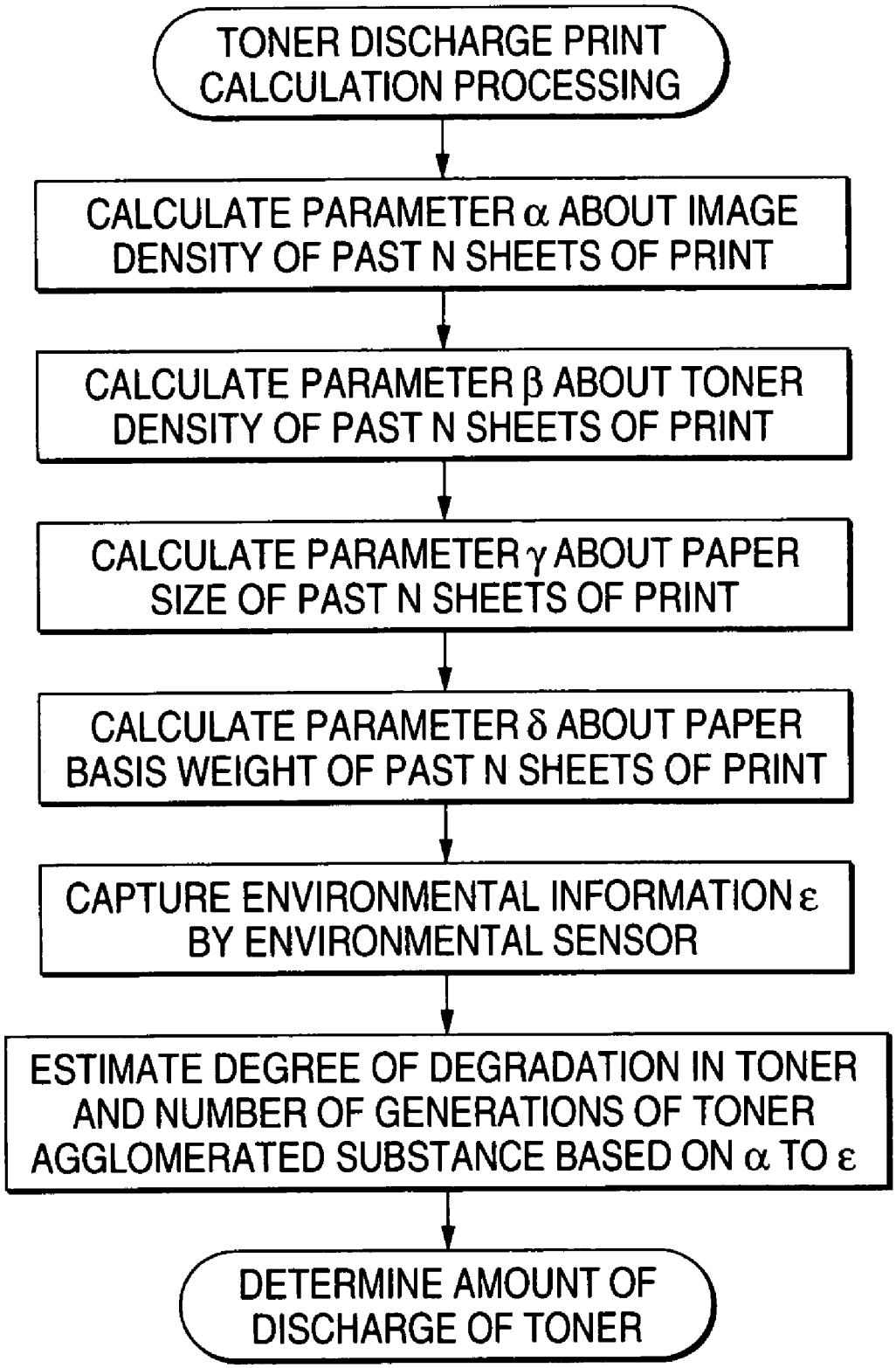
FIG. 10 is a flowchart showing toner discharge print calculation processing of FIG. 7.

Subsequently, toner discharge print calculation processing is performed as shown in FIG. 10.

This toner discharge print calculation processing is processing in which the past image output conditions and environmental conditions are considered and the degree of degradation in toner and the number of generations of a toner agglomerated substance are estimated to determine the amount of discharge of toner.

Here, as the past image output condition, for example, the following four conditions are considered properly in combination.

Parameter $\alpha$ About Image Density of the Past N Sheets of Print:

For example, the number of generations of a toner agglomerated substance can be estimated according to large and small relations between an average image density and a reference image density (a level at which the number of generations of a toner agglomerated substance is 0).

Parameter β About Toner Density of the Past N Sheets of Print:

The fact that a toner density is lower than a reference density corresponds to the fact that the number of toners is small accordingly, and stress is high and it becomes a factor in being susceptible to generation of a toner agglomerated substance.

Figure 11A:
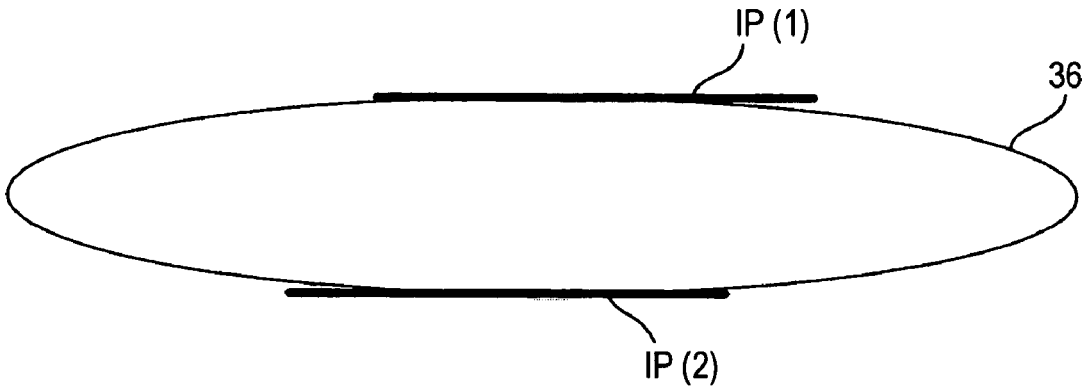
FIGS. 11A and 11B are explanatory diagrams showing forming layout examples of image panels by paper size.
Figure 11B:
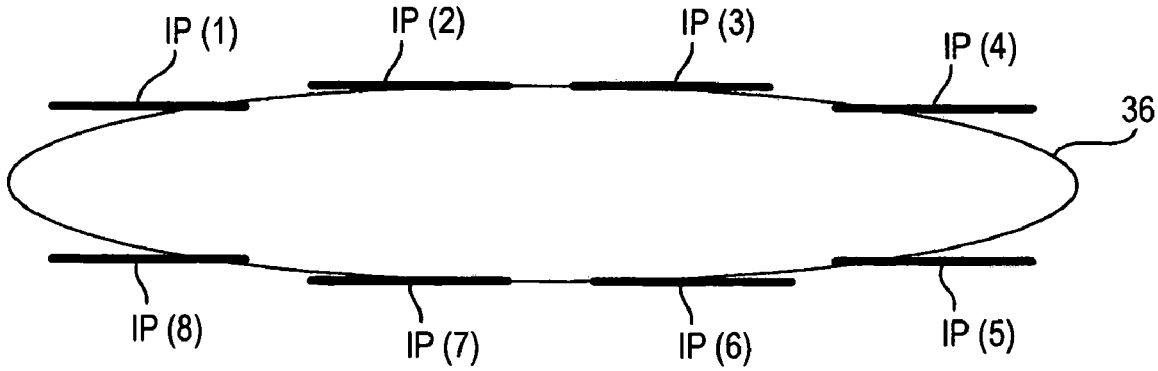

Parameter γ About Paper Size of the Past N Sheets of Print:

A situation in which an arrangement relation between image panels IP on the intermediate transfer belt 36 varies depending on the difference in paper size may occur. Specifically, for example, as shown in FIGS. 11A and 11B, for paper with a small size such as an A4 size, image panels IP (IP(1) to IP(8)) on the intermediate transfer belt 36 are arranged more closely as compared with paper with a large size, so that accordingly, an inter-image region becomes narrow and the developing device 33 has no time to stop the driving and it is forced to operate in an idle state. Therefore, the degree of stress on toner changes according to a condition of paper size and it becomes a factor in being susceptible to generation of a toner agglomerated substance as paper has a smaller size.

Parameter δ About Paper Basis Weight of the Past N Sheets of Print:

A situation in which an arrangement relation between image panels IP on the intermediate transfer belt 36 varies depending on the difference in paper basis weight may occur. Specifically, for example, as shown in FIG. 11A, for paper with a heavy basis weight such as cardboard, it is preferable to perform control of sufficient fixing at low speed in a subsequent fixing step and under such a request, image panels IP (IP(1), IP(2)) on the intermediate transfer belt 36 are arranged at sufficient spacing and accordingly, an inter-image region becomes long and in this range, driving of the developing device 33 can be stopped, so that the degree of stress on toner can be reduced. Therefore, it becomes a factor in being susceptible to generation of a toner agglomerated substance as paper has a heavier basis weight.

Also, environmental conditions ϵ consider the present conditions and include, for example, environmental information by a humidity sensor, a temperature sensor, etc. In this case, for example, for a condition of high humidity, it becomes a factor in being susceptible to generation of a toner agglomerated substance accordingly.

Figure 13A:
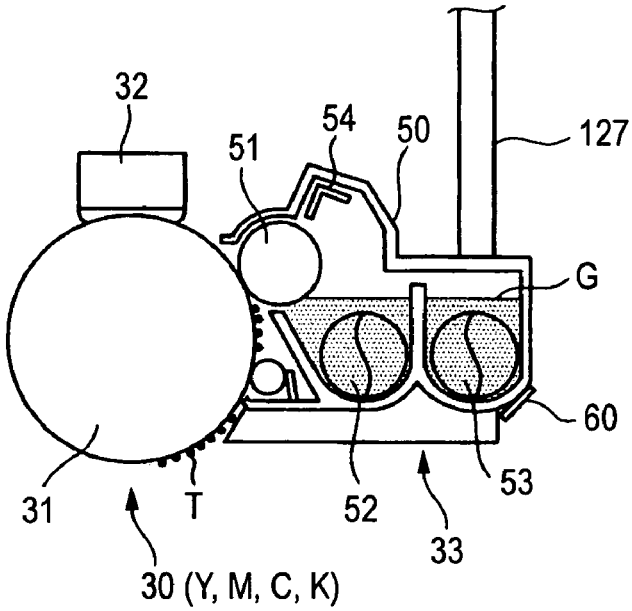
FIG. 13A is an explanatory diagram showing an action state of a developing device at the time of a toner discharge mode and FIG. 13B is an explanatory diagram showing an action state of a developing device at the time of a toner supply mode.

Subsequently, as shown in FIGS. 7 and 13A, a toner discharge mode is executed to do toner discharge printing.

This toner discharge mode is a mode of discharging toner by the amount of discharge of toner determined by the toner discharge print calculation processing and in the embodiment, a treatment for developing a solid image made of a toner discharge pattern on the photoconductor drum 31 is adopted.

Then, after the toner discharge pattern formed on the photoconductor drum 31 is primarily transferred to the intermediate transfer belt 36, the toner discharge pattern is secondarily transferred to paper automatically selected at the time of the toner discharge mode.

It is constructed so as to automatically select paper with the available maximum size as the paper selected at this time. Incidentally, it may naturally be constructed so as to change the paper size selected according to the amount of discharge of toner.

Figure 14A:
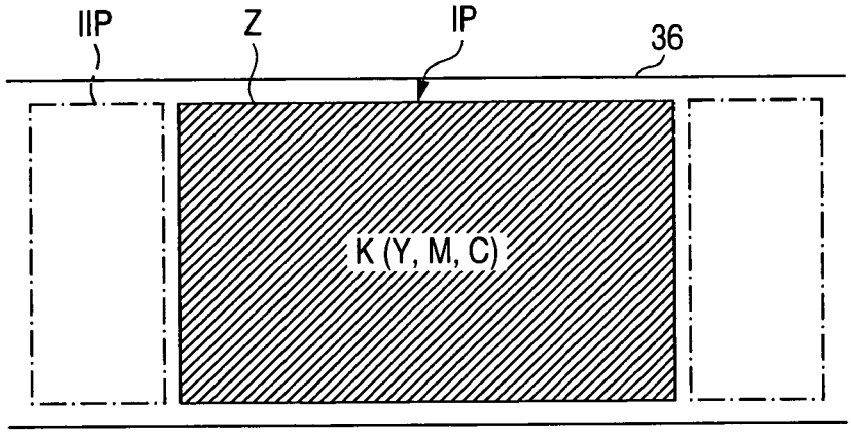
FIG. 14A is an explanatory diagram showing one example of a toner discharge pattern at the time of a toner discharge mode and FIG. 14B is an explanatory diagram showing another example of a toner discharge pattern at the time of the toner discharge mode and FIG. 14C is an explanatory diagram showing an action condition of a developing device of the toner discharge mode.
Figure 14B:
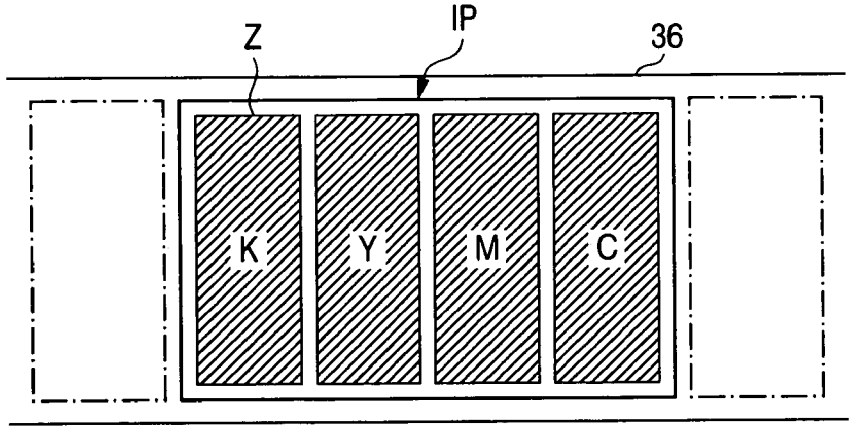

Here, as a toner discharge pattern Z, for example, it may be constructed so as to produce a toner discharge pattern Z for each color component over almost all of the image panel IP of the intermediate transfer belt 36 as shown in FIG. 14A, or may be constructed so as to partition and produce toner discharge patterns Z of each color component inside the image panel IP of the intermediate transfer belt 36 as shown in FIG. 14B.

Figure 14C:
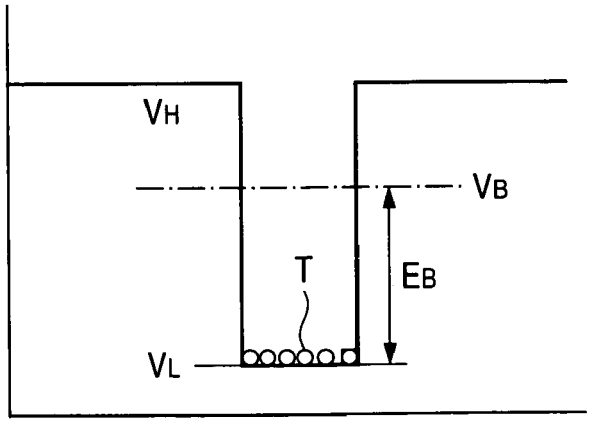

In the case of ensuring a large amount of discharge of toner (amount of development) as the toner discharge pattern Z at this time, it could be constructed so that a potential difference EB between a DC component of a development bias VB and an electrostatic latent image potential VL on the photoconductor drum 31 is set largely as shown in FIG. 14C.

Figure 15A:
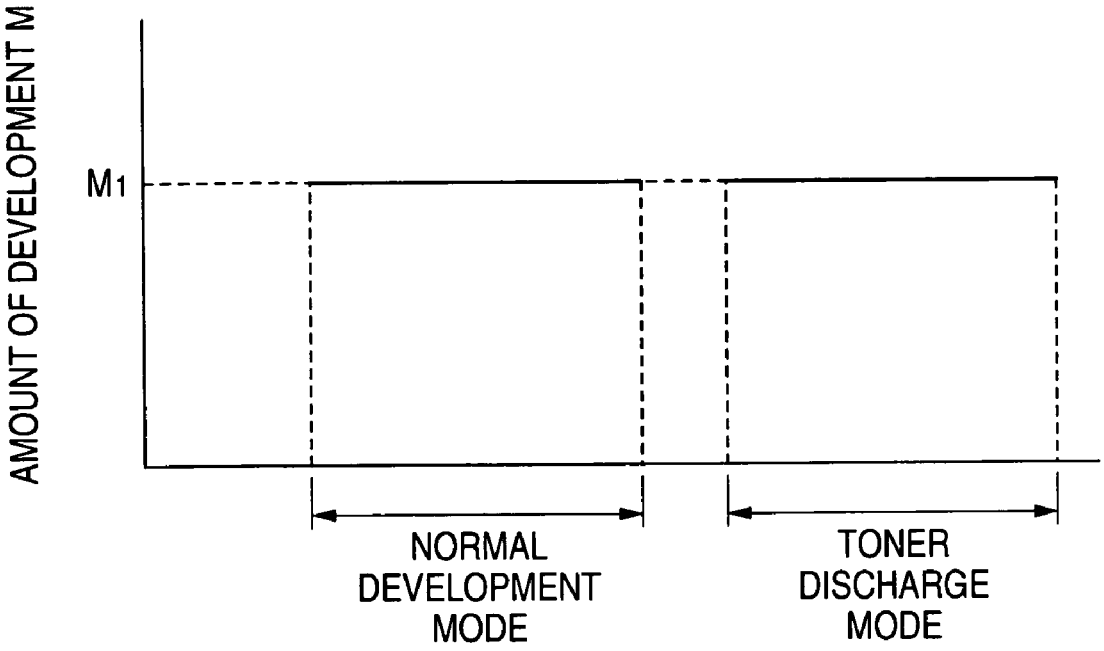
FIGS. 15A and 15B are explanatory diagrams showing the amount of development at the time of a toner discharge mode.
Figure 15B:
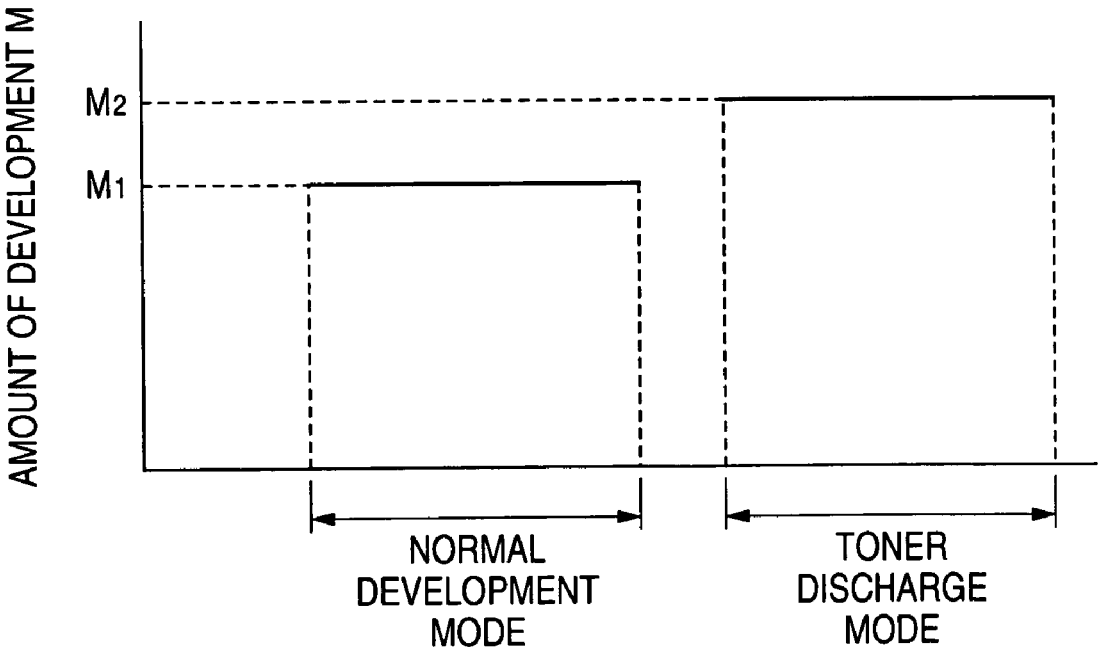

Also, the amount M of discharge of toner (amount of development) at the time of a toner discharge mode may be substantially similar to the amount M1 of development at the time of a normal development mode as shown in FIG. 15A, but the amount M may be set at a value M2 (M2>M1) larger than the amount M1 of development at the time of the normal development mode as shown in FIG. 15B.

In this case, as described above, selections may be made properly, for example, a DC component of a development bias VB is changed, or a peak-to-peak voltage of an AC component of the development bias VB is changed, or a development speed of the developing roll 51 is changed.

When such a toner discharge mode is executed, a toner agglomerated substance or degradation toner inside the developing device 33 is delivered surely.

Figure 13B:
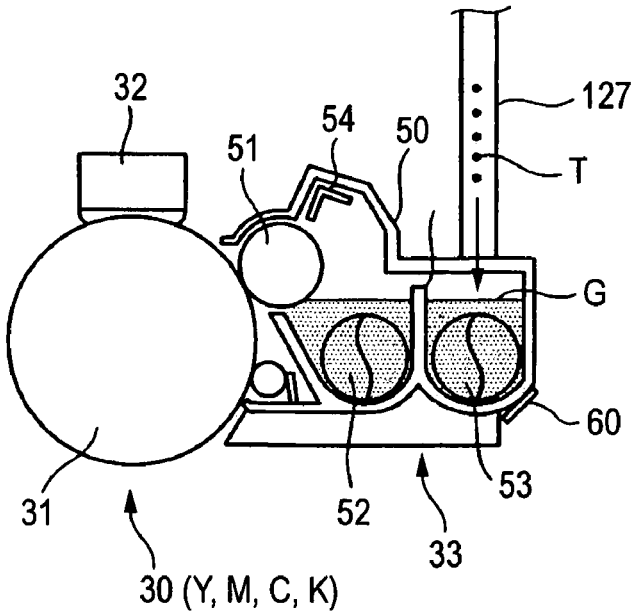

Subsequently, a toner supply mode is executed in conjunction with the toner discharge mode and as shown in FIG. 13B, a toner replenishment action (dispensing action) from the toner replenishment device 100 is performed.

This toner supply mode may be constructed so as to be performed during execution of the toner discharge mode, or may be constructed so as to be executed after the completion of the toner discharge mode.

Figure 12A:
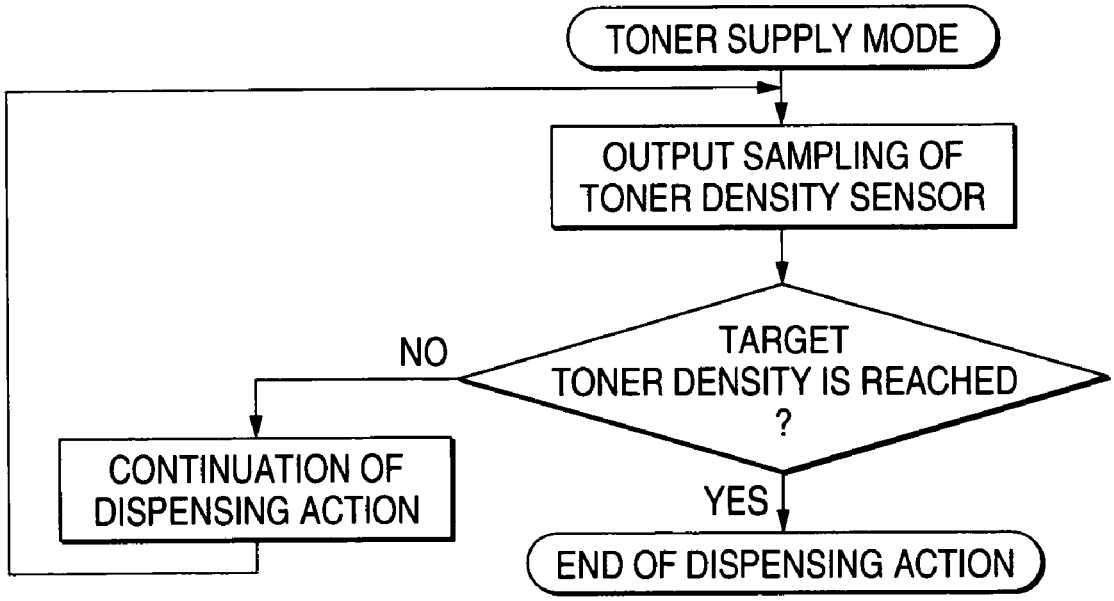
FIG. 12A is a flowchart showing one example of the contents of processing of a toner supply mode of FIG. 7

In this case, the toner replenishment device 100 continues a toner supply action until a toner density inside the developing device 33 reaches a target toner density while checking output sampling of a toner density sensor as shown in FIG. 12A.

Figure 12B:
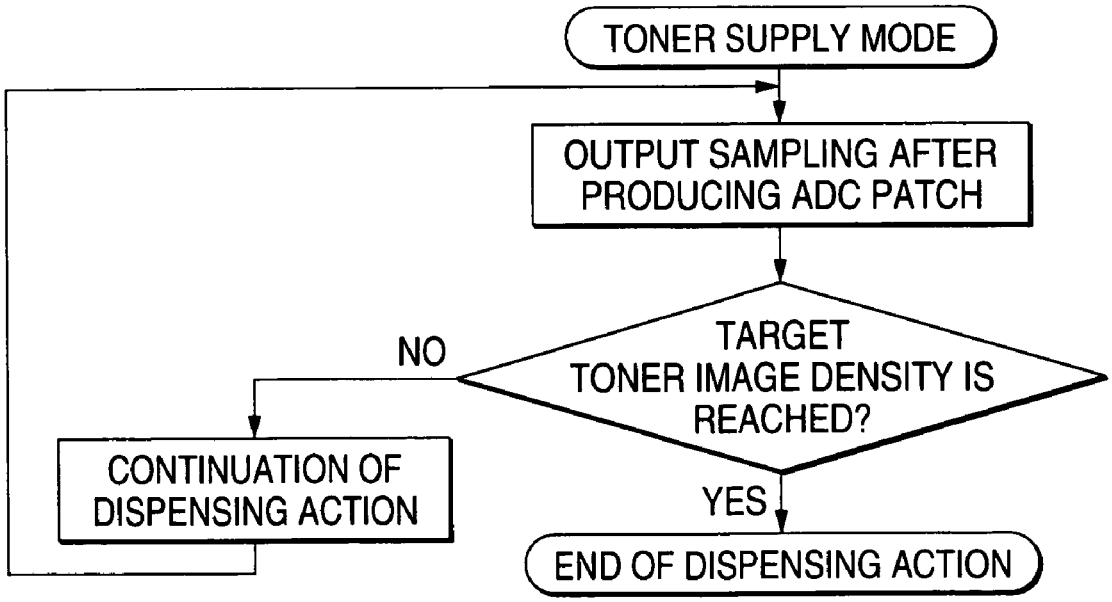
FIG. 12B is an explanatory diagram showing another example of the contents of the same processing.

Also, in the embodiment, the toner supply mode shown in FIG. 12A is executed, but it is not limited to this and, for example, as shown in FIG. 12B, output sampling after producing a patch (ADC (abbreviation of Auto Density Control) patch) for density detection on the photoconductor drum 31 is checked and a toner supply action is continued until the ADC patch reaches a target toner image density.

When such toner discharge mode and toner supply mode are executed, toner of shortage delivered in the toner discharge mode is supplied in the toner supply mode and also the toner density is controlled toward the target toner density, so that an image of high quality without a white spot defect or reduction in density can be obtained even when an image of a high image density is printed later.

Figure 16:
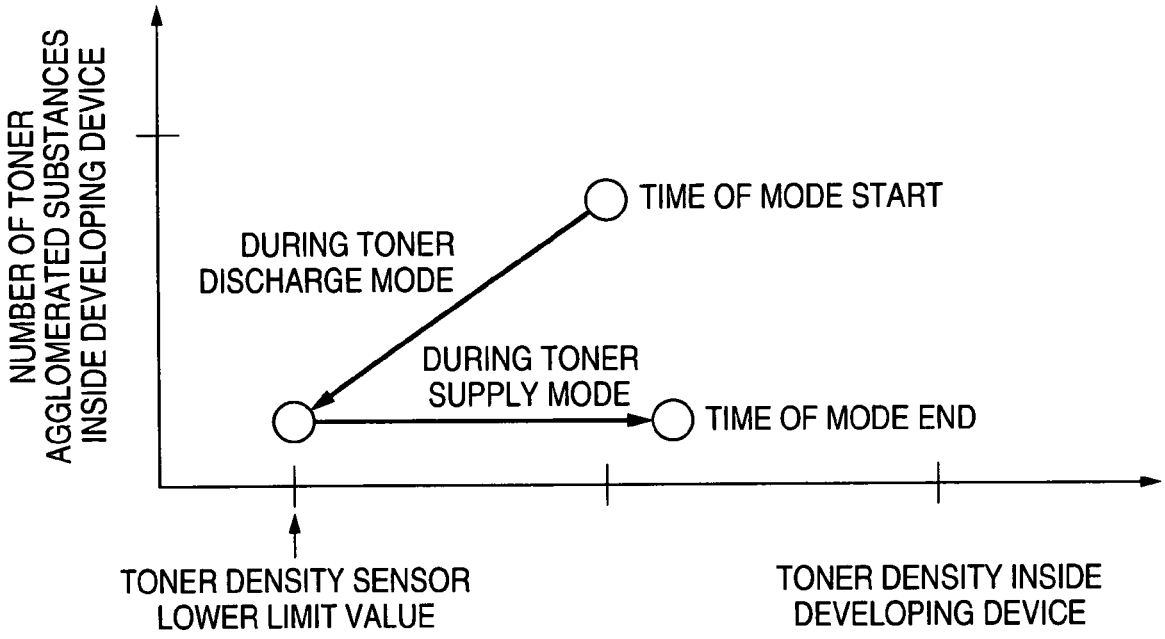
FIG. 16 is an explanatory diagram showing a relation between the number of toner agglomerated substances inside a developing device and a toner density inside the developing device at the time of a refresh mode.

A relation between the number of toner agglomerated substances inside the developing device and the toner density inside the developing device at this time is schematically shown in FIG. 16.

FIG. 16 demonstrates that the number of toner agglomerated substances inside the developing device 33 reduces in the toner discharge mode and the toner density inside the developing device 33 increases to the target toner density in the toner supply mode.

In order to check that a toner state inside the developing device is in a state which does not lead to an image quality defect, a user could again execute an image quality defect check print mode and see a check chart and decide the presence or absence of the image quality defect.

Figure 17:
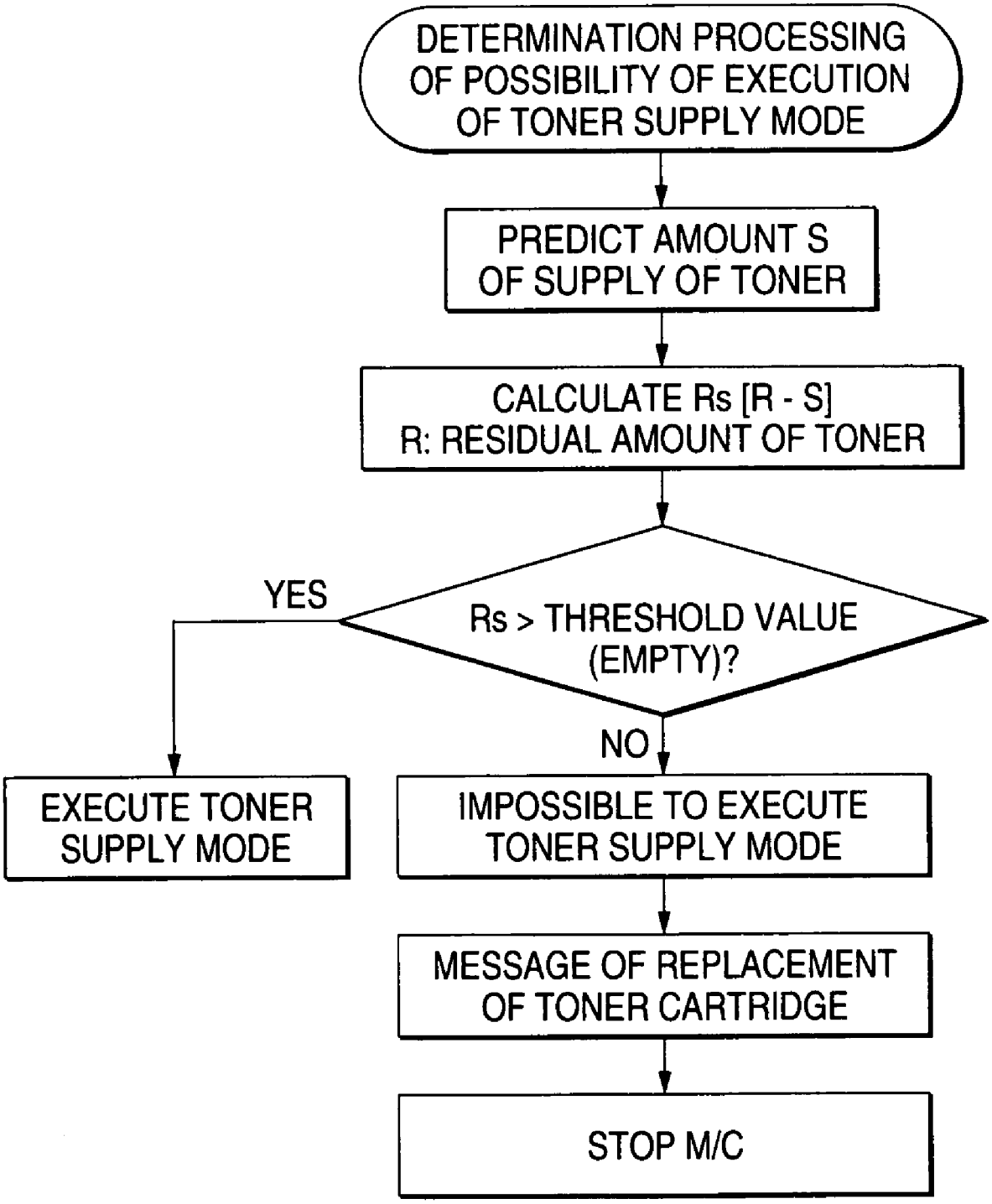
FIG. 17 is a flowchart showing determination processing of possibility of execution of a toner supply mode used in the first embodiment.

Further, in the embodiment, it is preferable to perform determination processing of possibility of execution of a toner supply mode as shown in FIG. 17.

In the determination processing of possibility of execution of this toner supply mode, the amount S of supply of toner from the toner replenishment device 100 is predicted from the amount of discharge of toner calculated and it is decided whether or not a difference RS between the amount S of supply of toner and the residual amount R of toner of the toner replenishment device 100 is larger than a threshold value (empty), and when the difference RS is larger than the threshold value (empty), the toner supply mode is executed and when the difference RS is smaller than or equal to the threshold value (empty), it is decided that it is impossible to execute the toner supply mode, and a message of replacement of a toner cartridge is displayed and also the image forming apparatus (M/C) is stopped.

Figure 18:
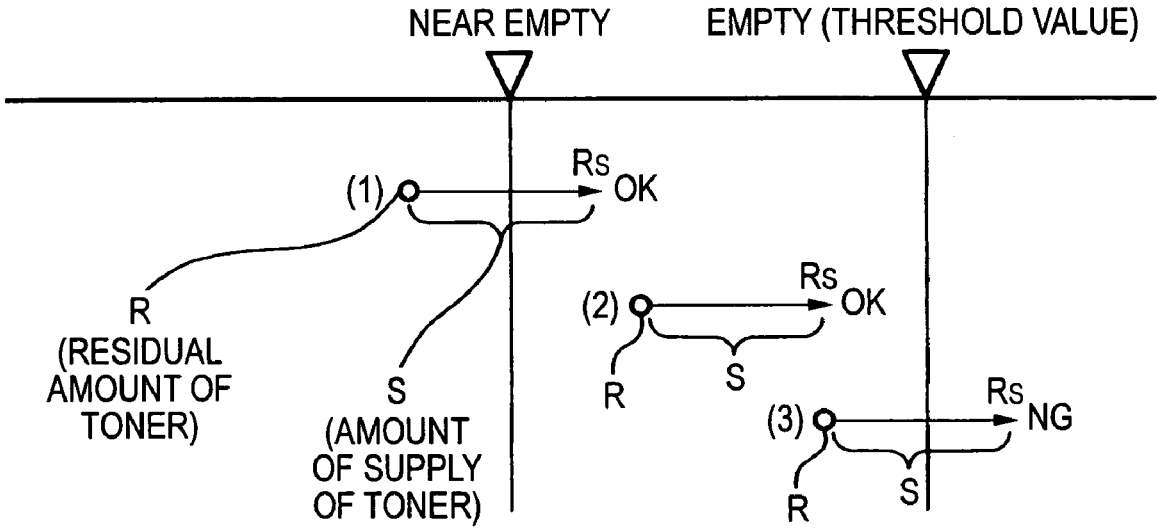
FIG. 18 is a schematic showing the determination processing of possibility of execution of a toner supply mode.

That is, while the toner supply mode is executed when it is assumed that the difference RS is larger than the threshold value (empty) as shown by (1) and (2) in FIG. 18, the amount of supply of toner runs short at first when it is assumed that the difference RS is smaller than or equal to the threshold value (empty) as shown by (3) in FIG. 18, so that it is decided that it is impossible to execute the toner supply mode.

Figure 19:
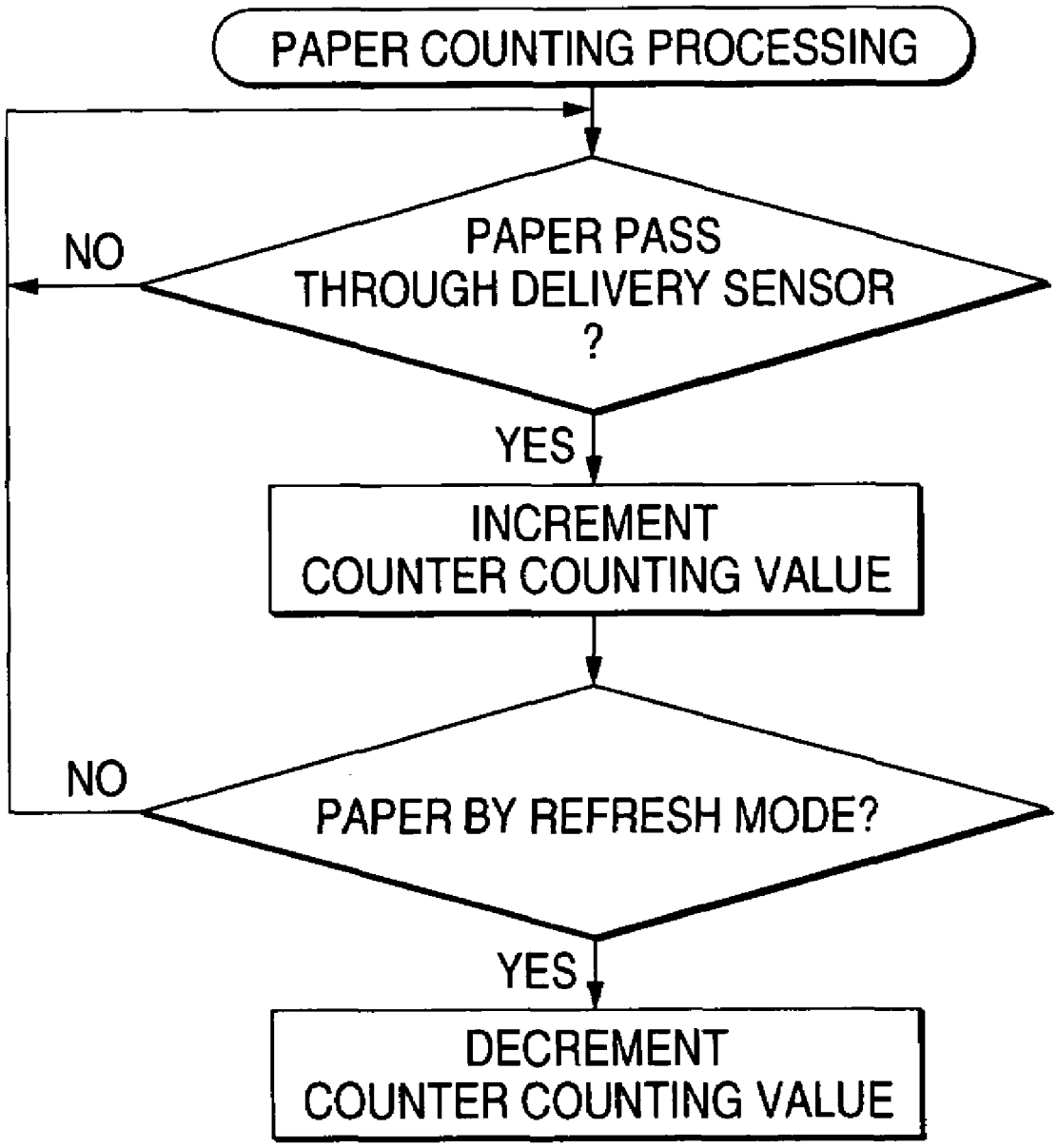
FIG. 19 is an explanatory diagram showing one example of paper counting processing used in the first embodiment.

Also, in the embodiment, it is preferable to perform paper counting processing as shown in FIG. 19 in an aspect of determining use fees of the image forming apparatus according to counting of paper.

This paper counting processing is processing in which it is checked whether or not paper passes through a delivery sensor (normally arranged in the just front delivered to a delivery tray), and when the paper passes through the delivery sensor, a counter counting value is incremented and it is checked whether or not to be the paper by a refresh mode and when it is the paper by the refresh mode, the counter counting value is decremented.

As a result of this, paper used at the time of the refresh mode is distinguished from paper at the time of a normal image forming mode and a counter is not counted, so that there is no fear that use fees of the image forming apparatus are added and charged for the paper used at the time of the refresh mode.

Figure 20:
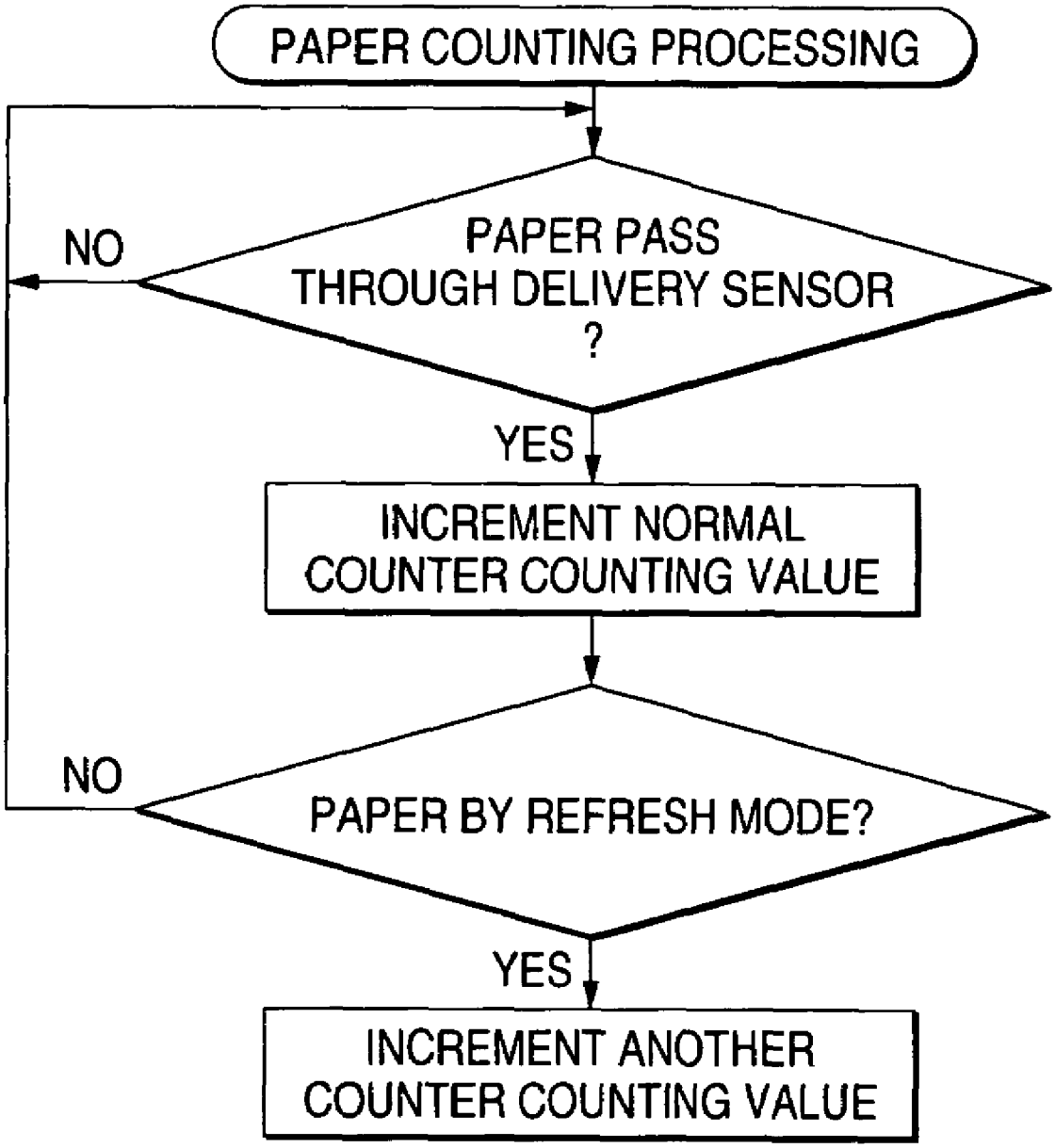
FIG. 20 is an explanatory diagram showing another example of the paper counting processing used in the first embodiment.

Also, as shown in FIG. 20, the paper counting processing may be constructed so that it is checked whether or not paper passes through a delivery sensor (normally arranged in the just front delivered to a delivery tray), and when the paper passes through the delivery sensor, a normal counter counting value is incremented and also it is checked whether or not to be the paper by a refresh mode and when it is the paper by the refresh mode, another counter counting value is incremented and a counting value of paper by the refresh mode is separately counted and distinguished from a normal counter.

Incidentally, in the embodiment, a toner discharge pattern Z is produced in an image panel IP of the intermediate transfer belt 36 and is transferred to paper and, for example, it may be constructed so that in addition to the image panel IP of the intermediate transfer belt 36, a toner discharge pattern Z is produced so as to range to an inter-image region IIP and the toner discharge pattern Z inside the image panel IP is transferred to paper and the toner discharge pattern Z of the inter-image region IIP is recovered by the drum cleaner 35 or the belt cleaner (not shown).

Further, in a model of mounting the belt cleaner or the drum cleaner 35 with a large capacity or a model of recovering the residual toner inside the belt cleaner or the drum cleaner 35 to a recovery box, it can also be constructed so as to recover a toner discharge pattern Z formed on the photoconductor drum 31 to the drum cleaner 35 etc. without being transferred to the paper side.

Second Embodiment

Figure 21:
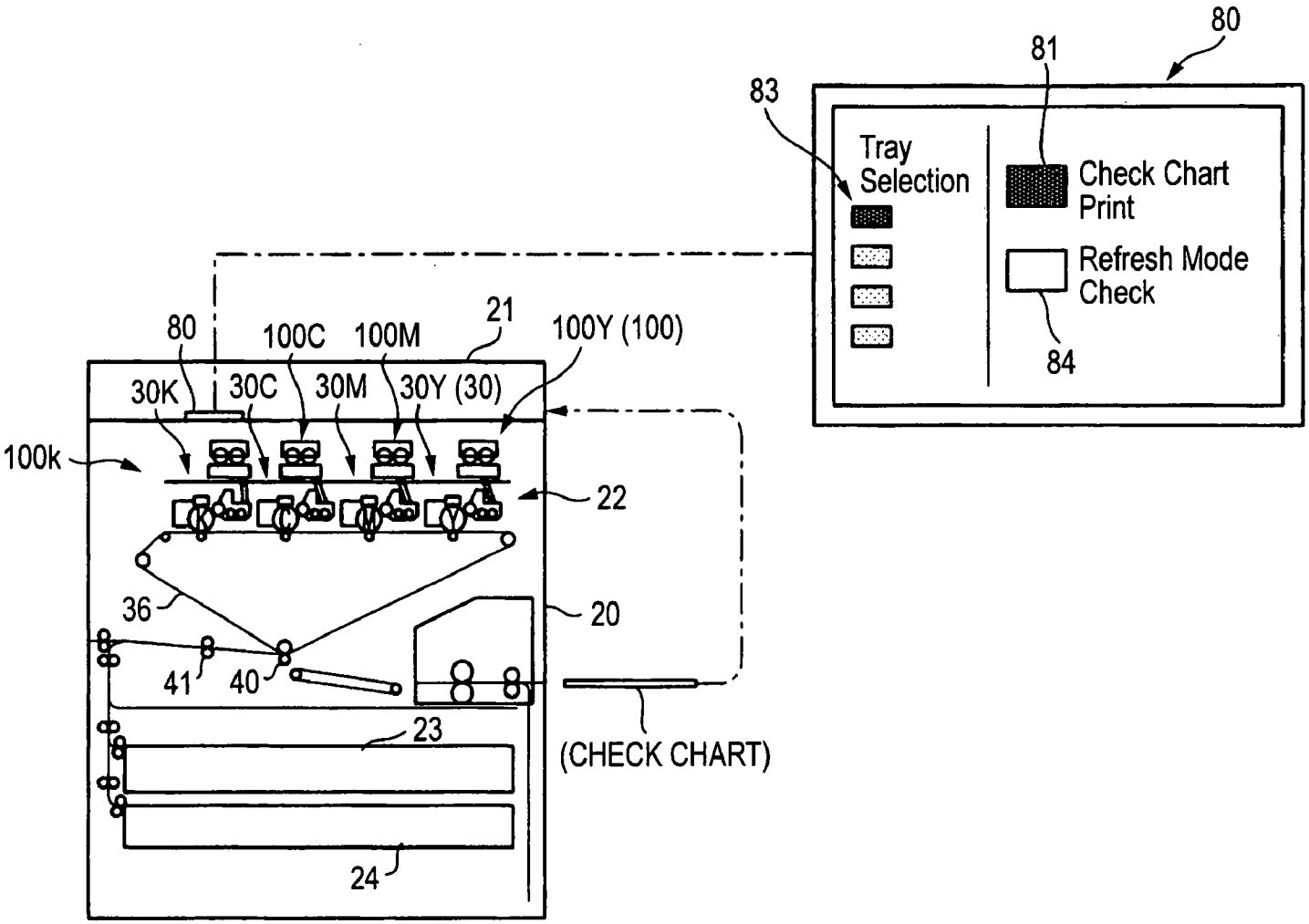
FIG. 21 is an explanatory diagram showing a main part of an image forming apparatus according to a second embodiment.

FIG. 21 shows a second embodiment of an image forming apparatus to which the invention is applied.

In FIG. 21, a basic configuration of the image forming apparatus is substantially similar to that of the first embodiment, but is designed to perform necessity determination processing of a refresh mode different from that of the first embodiment. Incidentally, detailed description of components similar to those of the first embodiment will be omitted herein by attaching numerals similar to those of the first embodiment.

Figure 22:
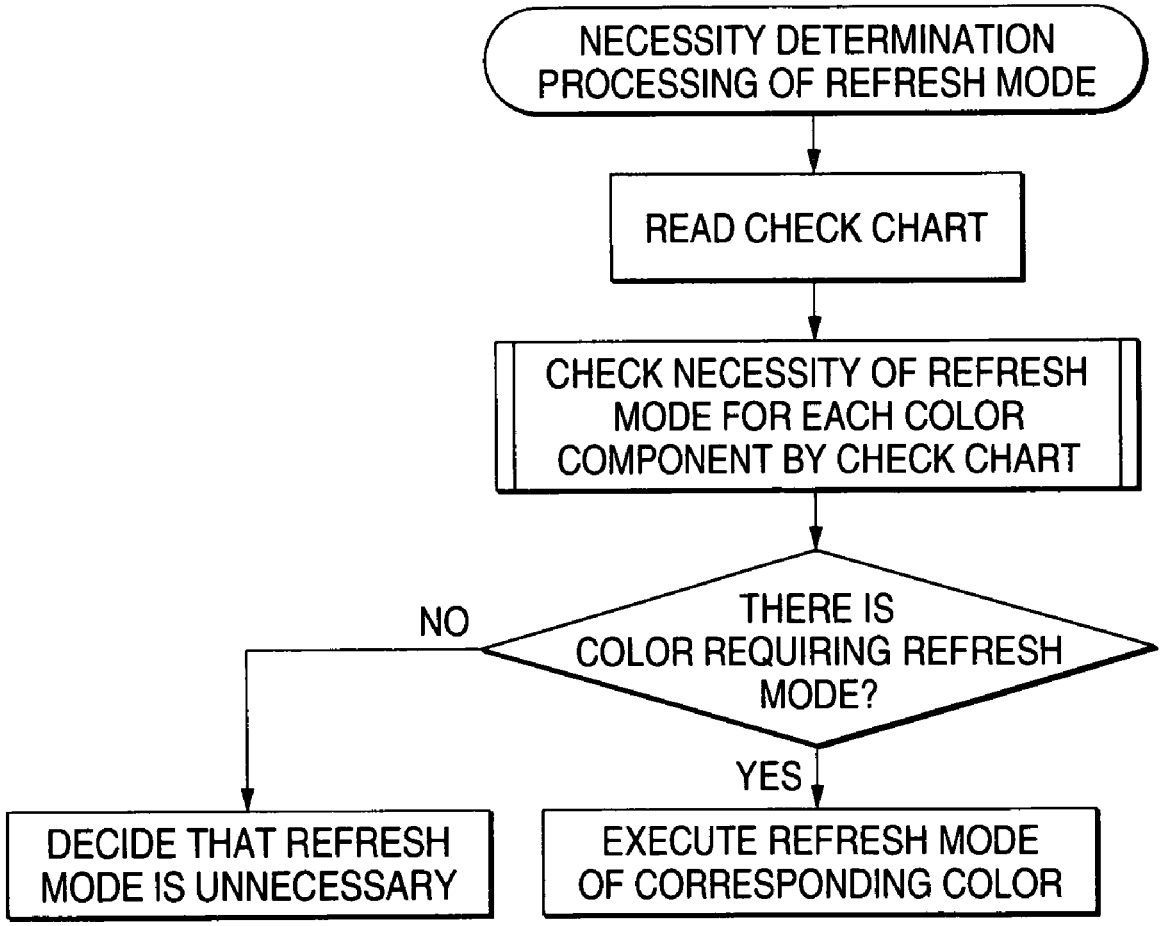
FIG. 22 is an explanatory diagram showing refresh mode necessity determination processing used in the second embodiment.

In the present embodiment, in the necessity determination processing of a refresh mode, as shown in FIGS. 21 and 22, after producing a check chart by pressing and operating a check chart print switch 81 of a control panel 80, a refresh mode check switch 84 is pressed and operated and thereby, the check chart is read by an image reading unit 21 and a refresh mode for each color component is checked by read information about this check chart and when there is a color requiring the refresh mode, the refresh mode of the corresponding color is executed and when there is no color, it is decided that the refresh mode is unnecessary.

Figure 23A:
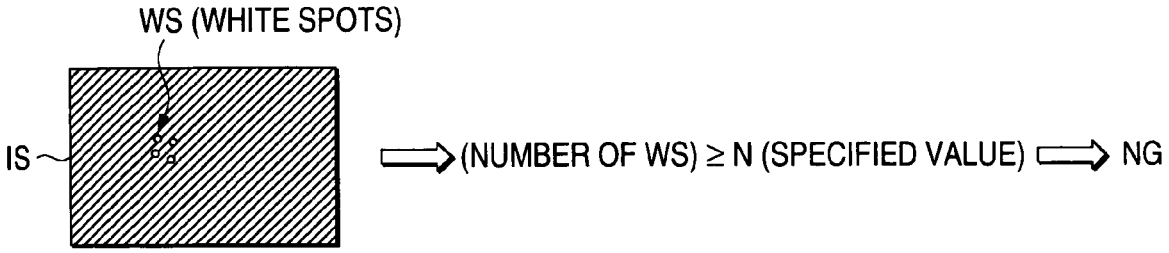
FIGS. 23A and 23B are explanatory diagrams showing a principle of a necessity check of a refresh mode.
Figure 23B:
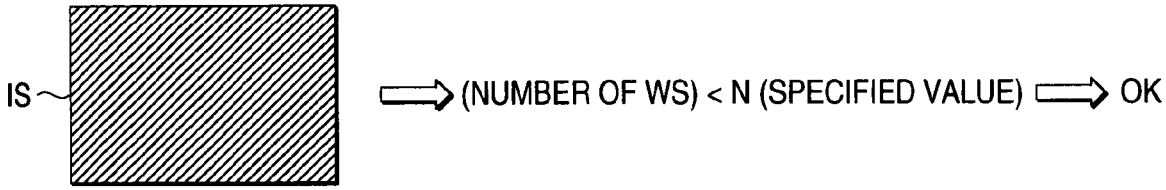

In this case, as a check treatment of the refresh mode for each component, for example, a treatment in which the number of white spots WS of a check chart IS is determined by comparing the check chart IS with a comparison chart stored previously and when the number of white spots WS is more than or equal to a specified value N as shown in FIG. 23A, it is decided that it is NG and when the number of white spots WS is less than the specified value N as shown in FIG. 23B, it is decided that it is OK is adopted.

According to this embodiment, it is constructed so as to automatically make a necessity determination of the refresh mode in the apparatus side, so that there is no fear that decisions on necessity of execution of the refresh mode vary depending on users, and the decisions are made correctly.

Third Embodiment

Figure 24:
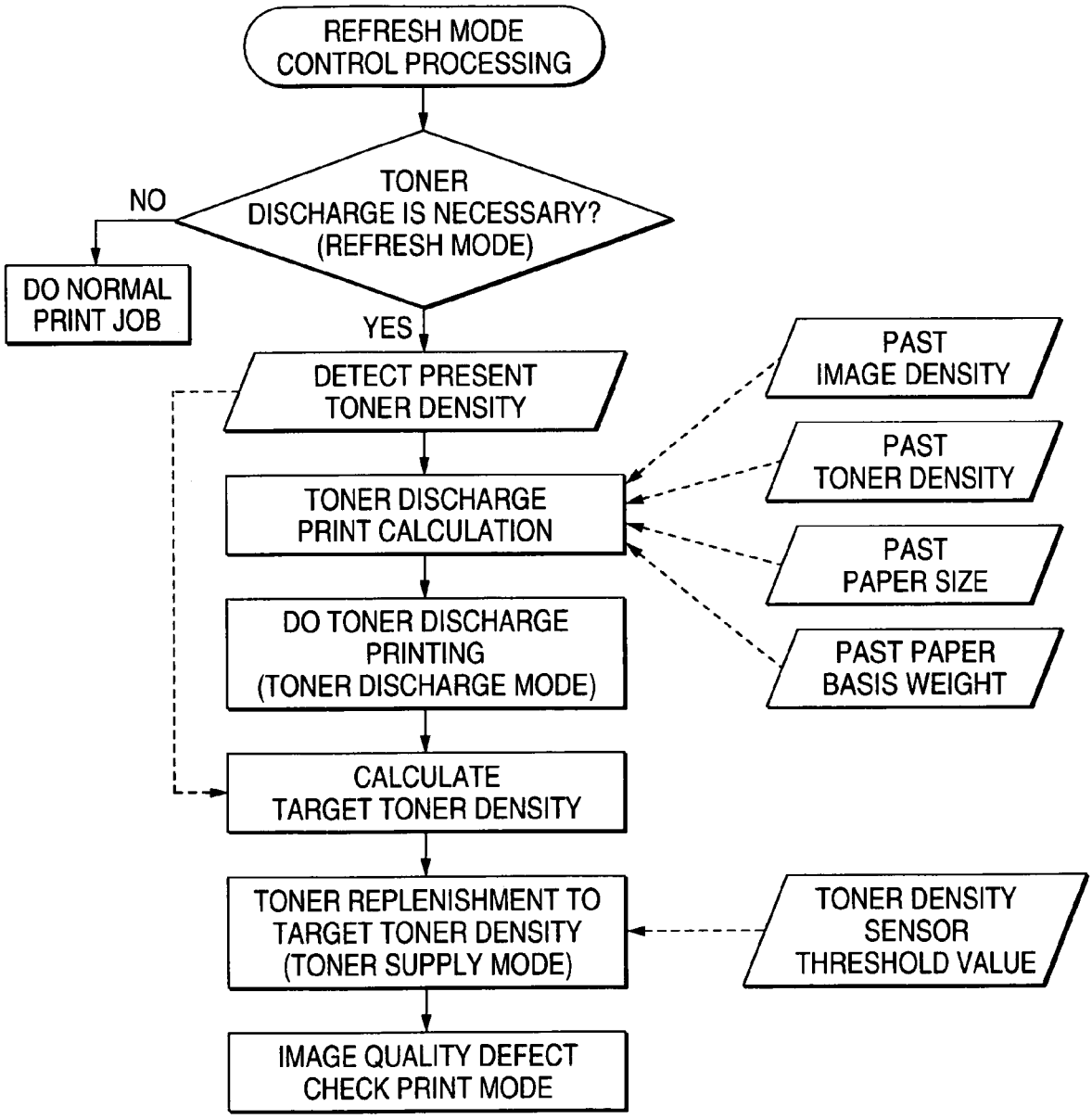
FIG. 24 is a flowchart showing refresh mode control processing of an image forming apparatus according to a third embodiment.

FIG. 24 is an explanatory diagram showing a main part of refresh mode control processing used in a third embodiment of an image forming apparatus according to the invention.

In FIG. 24, a basic configuration of the image forming apparatus is substantially similar to that of the second embodiment, but unlike the second embodiment, it is constructed so that a check chart is not produced and a necessity determination of a refresh mode is made without using this check chart. Incidentally, in FIG. 24, processing steps similar to the first embodiment are similar to those of the first embodiment.

Figure 25:
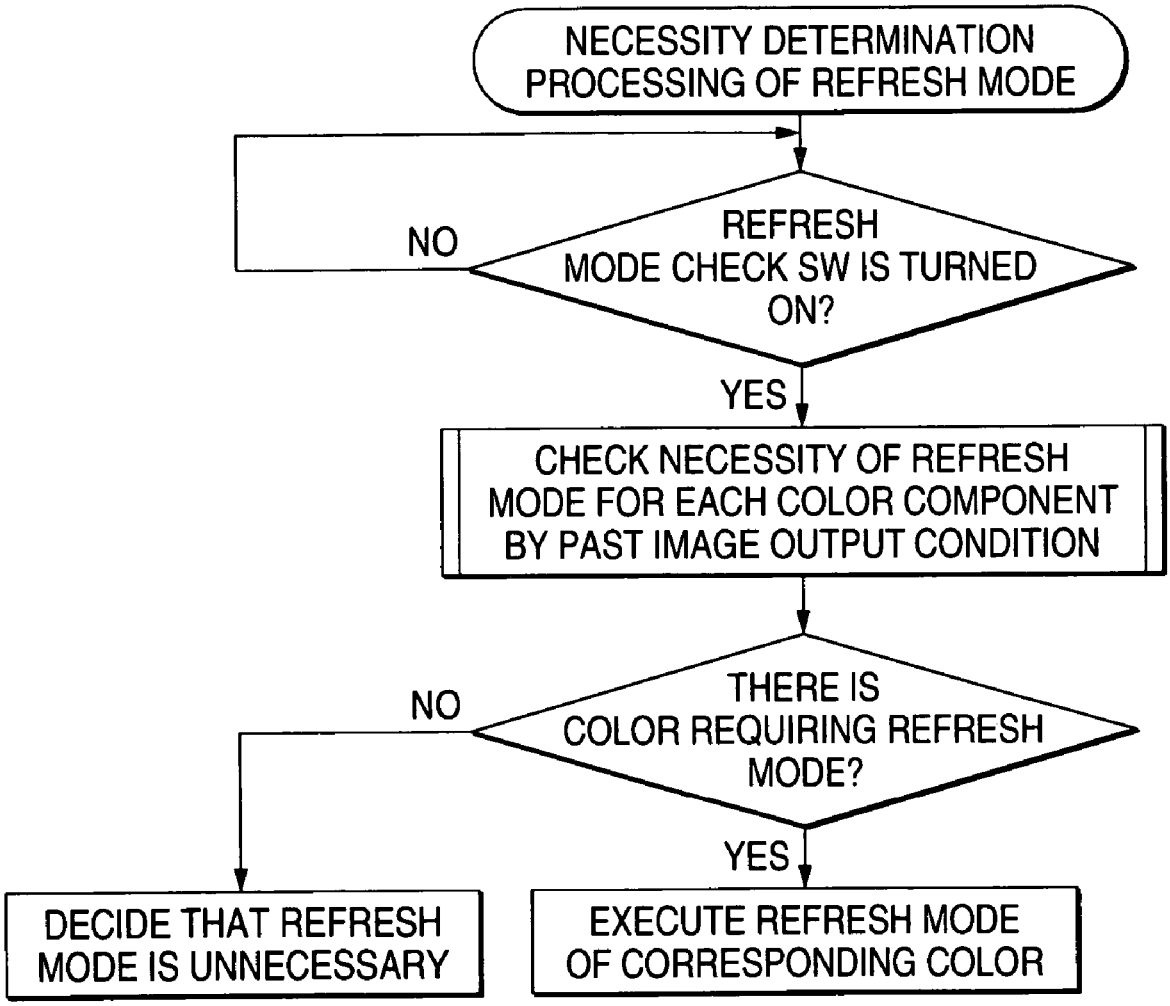
FIG. 25 is an explanatory diagram showing refresh mode necessity determination processing used in the third embodiment.

That is, in the present embodiment, in the refresh mode necessity determination processing, as shown in FIG. 25, when a refresh mode check switch 84 is pressed and operated, a refresh mode for each color component is checked by the past image output conditions and when there is a color requiring the refresh mode, the refresh mode of the corresponding color is executed and when there is no color, it is decided that the refresh mode is unnecessary.

Figure 26:
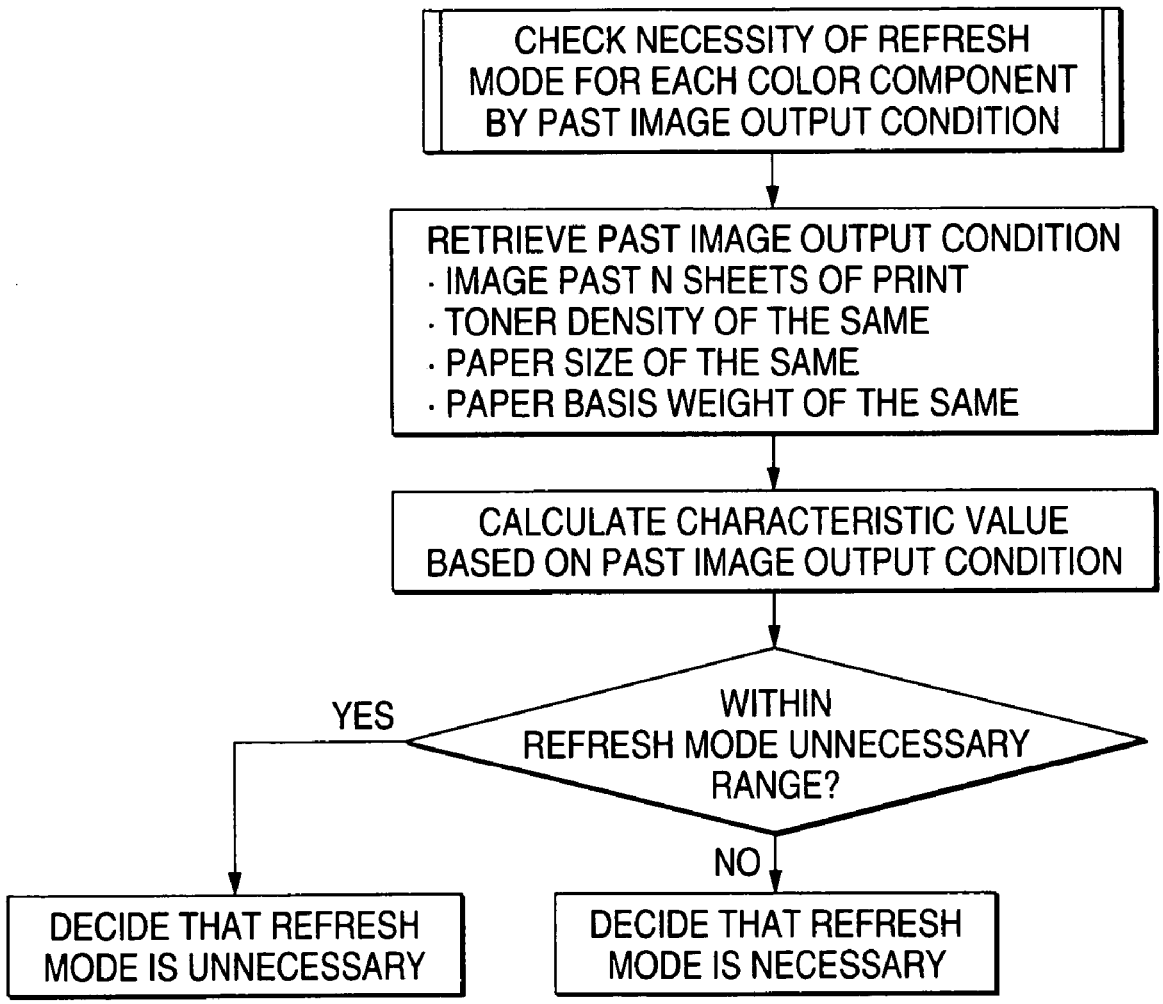
FIG. 26 is an explanatory diagram showing details of "necessity check of a refresh mode of each color component by the past image output conditions" of FIG. 25.

In this case, as a treatment for checking the refresh mode for each color component by the past image output conditions, as shown in FIG. 26, properly combined information about the past image output conditions, for example, image density of the past N sheets of print, toner density of the same, paper size of the same, paper basis weight of the same is retrieved and a characteristic value based on the past image output conditions is calculated based on this retrieved information and it is decided whether or not this characteristic value is within the refresh mode unnecessary range, and it is determined that the refresh mode is necessary or unnecessary.

Here, the characteristic value based on the past image output information could be constructed so as to weight the degree of influence on the number of generations of a toner agglomerated substance according to the information and be obtained based on the total sum.

According to the embodiment, an image quality defect factor of a developing device can be solved effectively by deciding a toner state inside the developing device based on the past image output conditions without producing the check chart particularly.

Fourth Embodiment

Figure 27:
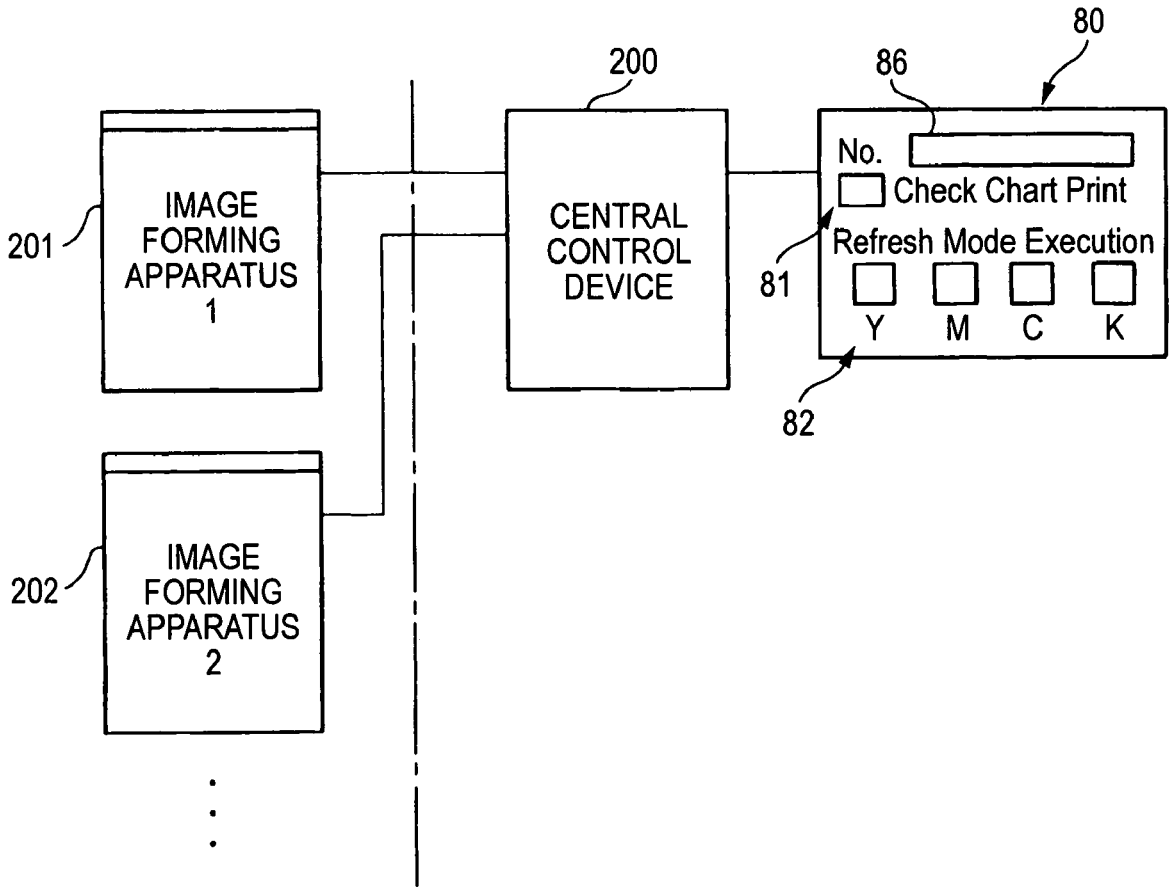
FIG. 27 is an explanatory diagram showing an image forming apparatus according to a fourth embodiment.

FIG. 27 shows a fourth embodiment of an image forming apparatus to which the invention is applied.

In FIG. 27, a basic configuration of image forming apparatus 201, 202, . . . is substantially similar to that of the first embodiment, but unlike the first embodiment, it is constructed so that network connection to a central control device 200 is made and remote operation from the central control device 200 can be performed.

That is, a control panel 80 similar to that of the first embodiment is arranged in the central control device 200, and this control panel 80 is provided with, for example, a check chart print switch 81, refresh mode execution switches 82 for each color component and a control number input field 86 for identifying the image forming apparatus of a client terminal to which network connection is made.

Therefore, in the present embodiment, it could be constructed so that in the central control device 200, the image forming apparatus 201 is now identified by the control number input field 86 and refresh mode control processing is performed with respect to this apparatus 201.

In this case, it could be constructed so that a check chart in the image forming apparatus 201 is transmitted to the side of the central control device 200 and a predetermined operation is performed by remote control from the side of the central control device 200 to the image forming apparatus 201.

According to the present aspect, with respect to the plural image forming apparatus, the refresh mode control processing can be centralized by the side of the central control device 200.

EXAMPLE

Example 1

Using a model of the image forming apparatus according to the first embodiment, a pixel count image density was changed and a developing device was successively operated and the number of generations of a toner agglomerated substance inside the developing device at that time was measured.

Figure 28:
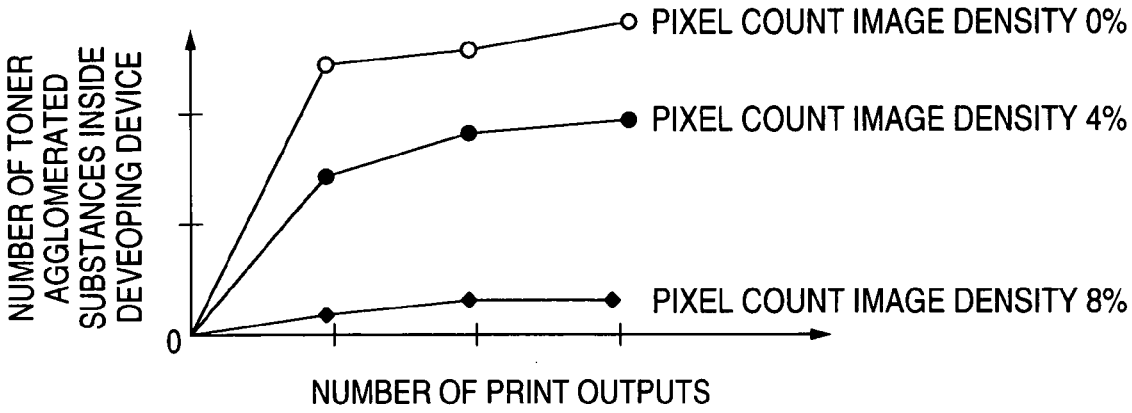
FIG. 28 is an explanatory diagram showing a relation between the number of toner agglomerated substances inside a developing device and the number of print outputs using a pixel count image density as a parameter in an image forming apparatus according to Example 1.

In the present example, as a result of changing the pixel count image density at 0%, 4%, 8% and measuring the toner agglomerated substances corresponding to the number of print outputs, a result shown in FIG. 28 was obtained.

FIG. 28 demonstrates that when the developing device is successively operated in a state of a low pixel count image density, the number of generations of the toner agglomerated substance inside the developing device increases, so that stress on toner inside the developing device is large accordingly.

Example 2

Figure 29:
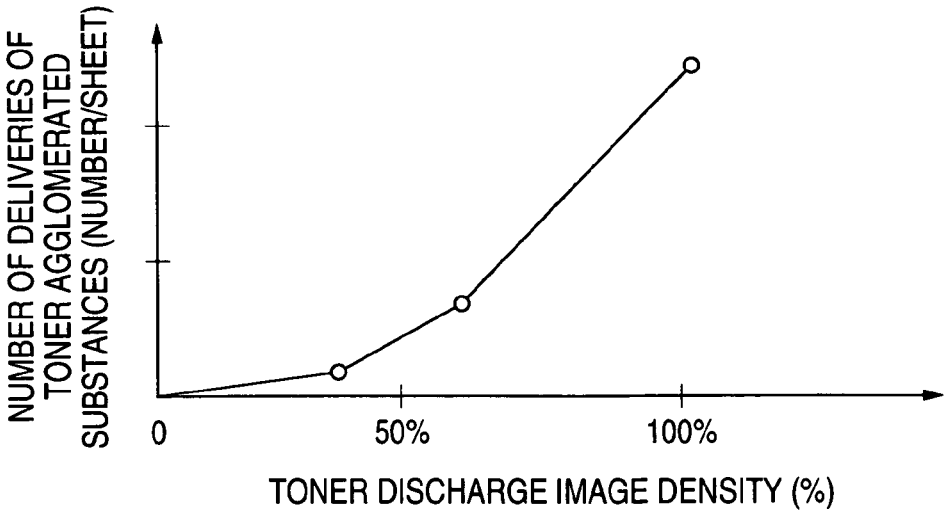
FIG. 29 is an explanatory diagram showing a relation between the number of deliveries of toner agglomerated substances inside a developing device and a toner discharge image density in an image forming apparatus according to Example 2.

Using a model of the image forming apparatus according to the first embodiment, as a result of changing a toner discharge image density and examining the number of deliveries of a toner agglomerated substance inside a developing device, a result shown in FIG. 29 was obtained.

FIG. 29 demonstrates that delivery performance of the toner agglomerated substance is better as the toner discharge image density is higher.

As a result of this, it is understood that a solid image with a high image density is preferably used as a toner discharge pattern at the time of a toner discharge mode.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

The entire disclosure of Japanese Patent Application No. 2004-228051 filed on Aug. 4, 2004 including specification, claims, drawings and abstract is incorporated herein by reference in its entirety.

What is claimed is:

1. An image forming apparatus comprising:

an image carrier which carries an electrostatic latent image;

at least one developing device which images the electrostatic latent image formed on the image carrier with a toner;

an instruction device that allows a user to input an instruction; and an image control device that controls, based on the instruction input through the instruction device, the developing device to forcedly consume the toner inside the developing device, wherein:

the toner forcedly consumed is larger than an amount of a toner discharged in a normal mode.

2. The image forming apparatus according to claim 1, wherein the image control device controls, based on the instruction input through the instruction device, the image carrier and the developing device to form a check sample having a predetermined pattern on a recording material, and the check sample is used for deciding a state of the toner inside the developing device.

3. The image forming apparatus according to claim 2, wherein:

the image forming apparatus comprises a plurality of developing devices, one of the developing devices stores a yellow toner therein, and the image control device controls, based on the instruction input through the instruction device, the image carrier and the developing device to form the check sample, which includes a yellow secondary color, on the recording material.

4. The image forming apparatus according to claim 1, wherein the image control device controls, based on the instruction, the developing device to forcedly consume the toner by causing the developing device to discharge the toner therefrom and develop the electrostatic latent image formed on the image carrier.

5. The image forming apparatus according to claim 1, wherein the image control device controls, based on the instruction, the developing device to forcedly consume the toner by causing the developing device to discharge the toner therefrom and develop the electrostatic latent image formed on at least an image forming region of the image carrier.

6. The image forming apparatus according to claim 1, further comprising a cleaner that removes a toner from the image carrier, wherein:

the image control device controls, based on the instruction, the developing device to forcedly consume the toner by causing the developing device to discharge the toner therefrom and develop the electrostatic latent image formed on the image carrier and by causing the cleaner to remove the discharged toner from the image carrier.

7. The image forming apparatus according to claim 1, wherein:

the image control device estimates a number of an agglomerated toner and a degree of degradation in the toner according to a degree of a toner state decided when the instruction is input through the instruction device, and the image control device determines the amount of the toner to be forcedly discharged in a range where the degradation toner and the agglomerated toner are ejected collectively.

8. The image forming apparatus according to claim 1, wherein:

the electrostatic latent image is formed over at least almost all of an image forming region of the image carrier, and the image control device controls, based on the instruction, the developing device to forcedly consume the toner to develop the electrostatic latent image into a solid image.

9. An image forming apparatus comprising:

an image carrier which carries an electrostatic latent image;

at least one developing device which images the electrostatic latent image formed on the image carrier with a toner;

wherein the image forming apparatus execute a toner forced discharge treatment which forcedly consumes a toner discharge mode in which the toner inside the developing device, a toner discharge judgment treatment capable of judging necessity of execution of the toner discharge mode based on a decision as to whether or not a toner state inside the developing device is in a state of leading to an image quality defect, and wherein the toner forced discharge treatment comprises developing the toner discharged from the developing device on an image forming region of the image carrier and extracting a developed image by the discharged toner to a recording material.

10. An image forming apparatus comprising:

an image carrier which carries an electrostatic latent image;

at least one developing device which images the electrostatic latent image formed on the image carrier with use of the toner;

a toner replenishment device that replenishes a new toner to the developing device; and an image forming apparatus that judges as to whether or not the toner inside the developing device is in a state of leading to an image quality defect and that judges as to whether or not it is necessary to cause the developing device to forcedly consume the toner inside the developing device, based on the judgment as to whether or not the toner inside the developing device is in the state of leading to the image quality defect, wherein:

when the image control device judges that it is necessary to cause the developing device to forcedly consume the toner inside the developing device, the image control device controls the developing device to forcedly consume the toner inside the developing device while controlling the toner replenishment device to supply the new toner to the developing device.

11. The image forming apparatus according to claim 10, wherein the image control device controls the toner replenishment device according to a toner density inside the developing device.

12. The image forming apparatus according to claim 10, wherein the image control device controls the toner replenishment device according to a toner image density during a period in which the toner is forcedly consumed.

13. The image forming apparatus according to claim 10, wherein the image control device controls the toner replenishment device so that a toner density inside the developing device reaches a predetermined toner density.

14. The image forming apparatus according to claim 10 wherein the image control device controls, based on the instruction input through the instruction device, the image carrier and the developing device to form a check sample having a predetermined pattern on a recording material, the check sample is used for deciding a state of the toner inside the developing device, the image control device judges, based on the check sample, as to whether or not it is necessary to cause the developing device to forcedly consume the toner inside the developing device, and after controlling the replenish device to supply the new toner to the developing device, the image control device controls the image carrier and the developing device to form the sample chart again.

15. The image forming apparatus according to claim 10, wherein the image control device judges as to whether or not it is necessary to cause the developing device to forcedly consume the toner, according to a residual amount of the toner in the toner replenishment device.

16. The image forming apparatus according to claim 15, wherein the image control device stops the image forming apparatus itself when the image control device judges that it is not necessary to cause the developing device to forcedly consume the toner.

17. An image forming method comprising:

judging whether or not a toner stored in a developing device of an image forming apparatus is in a state of leading to an image quality defect; and when it is judged that the toner is in the state of leading to the image quality defect, executing a toner discharge mode, which forcedly consumes the toner inside the developing device while supplying a new toner to the developing device.

18. An image forming apparatus comprising:

an image carrier that carries an electrostatic latent image thereon;

a developing device that images the electrostatic latent image formed on the image carrier with a toner;

an image reading device that reads an image formed on a recording material;

an image control device that controls the image carrier and the developing device to form a check sample having a predetermined pattern on a recording material, and controls the image reading device to read the check sample formed on the recording material, wherein:

the image control device determines based on the check sample read by the image reading device, as to whether or not it is necessary to control the developing device to forcedly consume the toner inside the developing device, and the toner forcedly consumed is larger than an amount of a toner discharged in a normal mode.

19. The image forming apparatus according to claim 1, wherein the image control device controls, based on the instruction, the developing device to forcedly consume the toner by causing the developing device to discharge the toner therefrom and develop the electrostatic latent image formed on an image forming region of the image carrier and by causing the image carrier to transfer a developed image to a recording material.

20. The image forming apparatus according to claim 19, wherein the image control device excludes a number of recording materials, which are used when the toner is forcedly consumed, from a number of recording materials used in a normal mode.

21. The image forming apparatus according to claim 19, wherein the image control device holds data of the number of recording materials, which are used when the toner is forcedly discharged, in an updatable recording medium.

22. The image forming apparatus according to claim 19, wherein when the toner is to be forcedly consumed, the image control device selects a recording material having a maximum size from among plural kinds of recording materials having different sizes and causes the image carrier to transfer a developed image to the selected recording material.

23. An image forming system comprising:

a central control apparatus; and an image forming apparatus connected to the central control apparatus through networks, wherein:

the image forming apparatus comprises:

an image carrier which carries an electrostatic latent image; and at least one developing device which images the electrostatic latent image formed on the image carrier with a toner, and the central control apparatus remotely controls the developing device to forcedly consume the toner inside the developing device.

* * * * *